United States Patent [19]

Tomishawa

[11] Patent Number: 4,889,099

[45] Date of Patent: Dec. 26, 1989

[54] AIR/FUEL MIXTURE RATIO CONTROL SYSTEM FOR INTERNAL COMBUSTION ENGINE WITH FEATURE OF LEARNING CORRECTION COEFFICIENT INCLUDING ALTITUDE DEPENDENT FACTOR

[75] Inventor: Naoki Tomishawa, Gunma, Japan

[73] Assignee: Japan Electronic Control Systems Company, Limited, Isezaki, Japan

[21] Appl. No.: 197,843

[22] Filed: May 24, 1988

[30] Foreign Application Priority Data

May 28, 1987 [JP] Japan ..... 62-129893
May 29, 1987 [JP] Japan ..... 62-131826
Jun. 16, 1987 [JP] Japan ..... 62-148035

[51] Int. Cl.[4] ..... F02M 51/00; F02M 25/06; F02D 41/14

[52] U.S. Cl. ..... 123/489; 123/440

[58] Field of Search ..... 123/489, 440, 438, 436, 123/419, 478; 364/431.08; 60/274, 285, 276

[56] References Cited

U.S. PATENT DOCUMENTS 4,753,208 6/1988 Yamado et al. ..... 123/489
4,761,950 8/1988 Nagai et al. ..... 123/489
4,766,870 8/1988 Nakajima et al. ..... 123/489
4,768,485 9/1988 Brandau et al. ..... 123/489
4,789,939 12/1988 Namburg ..... 123/489

*Primary Examiner*—Raymond A. Nelli
*Attorney, Agent, or Firm*—Foley & Lardner, Shcwartz, Jeffery, Schwaab, Mack, Blumenthal & Evans

[57] ABSTRACT

An air/fuel ratio control system controls fuel delivery amount on the basis of oxygen concentration in an exhaust gas. An air/fuel ratio dependent correction value is derived on the basis of the oxygen concentration. The air/fuel ratio control is performed in feedback mode and open loop mode. In feedback mode, fuel delivery amount is corrected utilizing a correction value which includes a learnt component. Learning of the learned component is performed during feedback mode operation. The learned component comprises a uniformly applicable air density dependent factor and an engine driving range dependent factor which is set with respect to each of the engine driving ranges. Learning of the air density factor and engine driving range dependent factor are selectively performed depending upon the engine driving condition.

33 Claims, 14 Drawing Sheets

AIR/FUEL MIXTURE RATIO CONTROL SYSTEM FOR INTERNAL COMBUSTION ENGINE WITH FEATURE OF LEARNING CORRECTION COEFFICIENT INCLUDING ALTITUDE DEPENDENT FACTOR

BACKGROUND OF THE INVENTION

1. Field of the Invention

The present invention relates generally to an air/fuel mixture ratio control system for an internal combustion engine. More specifically, the invention relates to a learning control system for controlling air/fuel ratio in a fuel injection internal combustion engine, which air/fuel ration control includes lambda (λ) control for performing FEEDBACK or CLOSED LOOP control on the basis of oxygen concentration contained in an exhaust gas. Further particularly, the invention relates to an air/fuel ratio learning control system including altitude depending control, which can precisely adjust air/fuel ratio depending upon density of air to be introduced for forming the air/fuel mixture.

2. Description of the Background Art

In the recent years, there have been proposed various air/fuel control systems for internal combustion engines. Some of the recently developed air/fuel ratio control systems incorporate learning control feature to continuously update correction coefficient for correcting a basic fuel injection amount based on oxygen concentration in an exhaust gas in order to maintain air/fuel ratio at a stoichiometric value. In case that air density dependent air/fuel ratio is concerned, the correction coefficient may be uniformly updated based on an oxygen concentration indicative sensor signal value (hereafter $O_2$ sensor signal) regardless of the engine driving range, in theory. However, in practice, because of tolerance in fuel injection valves, throttle body and other engine components, which causes deviation between arithmetically obtained basic fuel injection amount and practically required fuel injection amount, uniformly updating or learning of the correction coefficient regardless of engine driving range is practically not possible. By this, it is practically required to set learned correction coefficient for respective engine driving range.

In this view, learning control systems with FEEDBACK control feature for controlling air/fuel ratio have been recently proposed in the Japanese Patent First (unexamined) Publication (Tokkai) Showa No. 60-90944 and the Japanese Patent First Publication (Tokkai) Showa No. 61-190142. In the disclosed system, a basic fuel injection amount is derived on the basis of preselected basic fuel injection control parameter or parameters, such as an intake air flow rate, an engine revolution speed and so forth. The basic fuel injection amount thus derived is modified employing a feedback correction coefficient which is derived on the basis of oxygen sensor in an exhaust system and composed of a proportional (P) component and an integral (I) component. By modifying the fuel injection amount on the basis of the feedback correction coefficient, air/fuel ratio can be FEEDBACK controlled toward a stoichiometric value. Furthermore, the disclosed system derives a learnt correction coefficient with respect to mutually distinct various engine operation range. In practice, the learned correction coefficient is determined by deriving a difference between the feedback correction coefficient and a predetermined reference value. This learned correction coefficient is used in OPEN LOOP mode air/fuel ratio control to derive the fuel injection amount. The learned correction coefficient may also be used in the FEEDBACK or CLOSED LOOP mode air/fuel ratio control together with the feedback correction coefficient.

Such a system assures to perform air/fuel ratio control in the FEEDBACK mode operation to maintain the air/fuel ratio precisely at the stoichiometric value. Furthermore, since the learned correction coefficient may serve to maintain desired air/fuel ratio even in OPEN LOOP mode operation.

However, in the aforementioned type of learning control system, drawback may be encountered in an engine driving condition where the engine driving or operation range frequently fluctuates. For example, in hill or mountain climbing, the air/fuel ratio control mode is held in transition mode condition between FEEDBACK mode and OPEN LOOP mode to too frequently change engine driving range to update learned correction coefficient during FEEDBACK mode operation. Therefore, the learned correction coefficient may not reflect the instantaneous air density. This causes delay in FEEDBACK mode control after the driving condition returns to stable state satisfying FEEDBACK condition. Furthermore, in the OPEN LOOP control, the air/fuel ratio tends to deviate far from the stoichiometric value to degrade drivability.

SUMMARY OF THE INVENTION

It is an object of the present invention to provide an air/fuel ratio control system which can precisely control fuel delivery amount at any altitude condition and can provide sufficiently high response characteristics to altitude change.

Another object of the invention is to introduce a control feature in the air/fuel ratio control for optimizing air/fuel control at any environmental condition.

In order to accomplish aforementioned and other objects, an air/fuel ratio control system, according to the present invention, controls fuel delivery amount on the basis of oxygen concentration in an exhaust gas. An air/fuel ratio dependent correction value is derived on the basis of the oxygen concentration. The air/fuel ratio control is performed in feedback mode and open loop mode. In feedback mode, fuel delivery amount is corrected utilizing a correction value which includes a learned component. Learning of the learnt component is performed during feedback mode operation. The learned component comprises an uniformly applicable air density dependent factor and a engine driving range dependent factor which is set with respect to each of the engine driving ranges. Learning of the air density factor and engine driving range dependent factor are selectively performed depending upon the engine driving condition.

This introduces altitude dependent air/fuel ratio control. According to the invention, altitude dependent control can be taken place even in engine high speed and high load condition for improving response characteristics in air/fuel ratio control at any altitude condition.

In the alternative, the control feature may be introduced in the air/fuel ratio control for optimizing air/fuel ratio control at any altitude.

According to one aspect of the invention, an air/fuel ratio control system for controlling a mixture ratio of an air/fuel mixture to be introduced into a combustion chamber in an internal combustion engine, comprises an air/fuel mixture induction system for introducing an intake air and a fuel for forming an air/fuel mixture to be supplied into an engine combustion chamber, the air/fuel mixture delivery system incorporating a fuel metering means for delivering a controlled amount of fuel, a first sensor means for monitoring a preselected basic first engine operation parameter to produce a first sensor signal indicative thereof, a second sensor means for monitoring an air/fuel mixture ratio indicative parameter for producing a second sensor signal variable of the value indicative of a deviation from a threshold value representative of a stoichiometric value, third means for deriving a basic fuel metering amount on the basis of the first sensor signal value, fourth means for deriving a air/fuel ratio dependent correction factor variable of the value thereof depending upon the second sensor signal value, fifth means for deriving an air density dependent first correction coefficient on the basis of the air/fuel ratio dependent correction factor for air/fuel ratio dependent correction of the basic fuel metering amount, which first correction coefficient is commonly applicable for correction of the basic fuel metering amount in over all engine driving ranges, the fifth means updating the first correction coefficient when a first learning condition is satisfied, a sixth means for deriving a second correction coefficient which is variable depending upon the engine driving range on the basis of the air/fuel ratio dependent correction factor, the sixth means setting a plurality of the second correction coefficient in relation to respectively corresponding engine driving range and updating each of the second correction coefficient with an instantaneous value derived based on the air/fuel ratio dependent correction factor in the corresponding engine driving range, a seventh means for detecting engine driving condition on the basis of the first sensor signal values and governing the fifth and sixth means for selectively operating one of the fifth and sixth means depending upon the detected engine driving condition, and an eighth means for correcting the basic fuel metering amount with the correction coefficient to control the fuel metering means for delivering the fuel in the amount corresponding to the corrected fuel metering amount to the air/fuel mixture delivery system.

The seventh means may detect the engine driving condition satisfying a predetermined feedback control condition for producing a feedback condition indicative signal to selectively enable the fifth and sixth means for updating one of the first and second correction coefficient and to disable the fifth and sixth means when the feedback condition is not satisfied.

The air/fuel ratio control system further comprises a ninth means for detecting engine driving condition in high speed and high load, which is out of the feedback condition, to measure an elapsed period where the high speed and high load condition is maintained, the ninth means modifying the first correction coefficient when the measured elapsed time becomes longer than or equal to a predetermined period. The ninth means cyclically modifies the first correction coefficient by a predetermined value while the engine is maintained at the high speed and high load condition. The second sensor means varies polarity of the second sensor signal value when air/fuel ratio varies across a stoichiometric value, and which further comprises a tenth means for measuring an elapsed time in which the polarity of the second sensor signal value is held unchanged to detect abnormality of the second sensor means. The tenth means disables the ninth means when abnormality of the second sensor means is detected.

The first sensor means preferably includes means for monitoring an engine load indicative parameter and means for monitoring an engine speed indicative parameter, and the seventh means derives a first criterion on the basis of an engine speed derived on the basis of the monitored engine speed indicative parameter and compares an engine load derived based on the engine load indicative parameter with the first criterion for enabling the fifth means when the engine load is greater than or equal to the first criterion, and enabling the sixth means when the engine load is smaller than the first criterion. The seventh means further derives a second criterion on the basis of the engine speed, which second criterion is set at a greater value than the first criterion and compares the engine load with the second criterion so as to disable the fifth means when the engine load is greater than the second criterion.

The second sensor means may vary polarity of the second sensor signal value when air/fuel ratio varies across a stoichiometric value, and the fifth and sixth means, as being triggered by the seventh means, being responsive to change of polarity of the second sensor signal to update the first and second correction coefficients.

The air/fuel ratio control system further comprises a detector means detective of engine driving condition satisfying a predetermined feedback control condition for producing a feedback condition indicative signal to operate the eighth means in feedback mode for correcting the basic fuel metering amount with the first and second correction coefficients and to operate the eighth means in open loop mode for disabling correction of the basic fuel metering amount utilizing the first and second correction coefficients, and the seventh means selectively enables the fifth and sixth means for updating the first and second correction coefficients while the eighth means operates in feedback mode. The fourth means is active in presence of the feedback condition indicative signal to cyclically derive the correction factor, and the sixth means is active for deriving the second correction coefficient on the basis of the correction factor only when the feedback condition indicative signal is present. The fourth means samples upper and lower peak values of the second sensor signal value for deriving the correction factor by averaging the upper and lower peak values. The first sensor means monitors an engine speed indicative parameter and an engine load indicative parameter so that the third means derives the basic fuel metering amount on the basis of the engine speed indicative parameter and the engine load indicative parameter, and the fifth means detects the engine driving range on the basis of the engine speed and the basic fuel metering amount. The first sensor means monitors a throttle valve angular position and derives the engine load indicative parameter on the basis of the throttle valve angular position and the engine speed.

According to another aspect of the invention, an air/fuel ratio control system for controlling a mixture ratio of an air/fuel mixture to be introduced into a combustion chamber in an internal combustion engine, comprises an air/fuel mixture induction system for introducing an intake air and a fuel for forming an air/fuel mixture to be supplied into an engine combustion chamber, the air/fuel mixture delivery system incorporating a fuel metering means for delivering a controlled amount of fuel, a first sensor means for monitoring a preselected basic first engine operation parameter to produce a first sensor signal indicative thereof, the first sensor signal including an engine load indicative component, a second sensor means for monitoring an air/fuel mixture ratio indicative parameter for producing a second sensor signal variable of the value indicative of a deviation from a threshold value representative of a stoichiometric value, third means for deriving a basic fuel metering amount on the basis of the first sensor signal value, fourth means for deriving a air/fuel ratio dependent correction factor variable of the value thereof depending upon the second sensor signal value, fifth means for deriving an air density dependent first correction coefficient on the basis of the air/fuel ratio dependent correction factor for air/fuel ratio dependent correction of the basic fuel metering amount, which first correction coefficient is commonly applicable for correction of the basic fuel metering amount in over all engine driving ranges, the fifth means updating the first correction coefficient when a first learning condition is satisfied, a sixth means for deriving a second correction coefficient which is variable depending upon the engine driving range on the basis of the air/fuel ratio dependent correction factor, the sixth means setting a plurality of the second correction coefficient in relation to respectively corresponding engine driving range and updating each of the second correction coefficient with an instantaneous value derived based on the air/fuel ratio dependent correction factor in the corresponding engine driving range, a seventh means, associated with the sixth means, for deriving an altitude dependent correction value for modifying the second correction value on the basis of the engine load component of the first sensor signal and a tendency of air/fuel ratio adjustment in a given cycles of the second sensor signal variations, an eighth means for correcting the basic fuel metering amount with the correction coefficient to control the fuel metering means for delivering the fuel in the amount corresponding to the corrected fuel metering amount to the air/fuel mixture delivery system.

The seventh means may derive the altitude dependent correction value constituting a first component variable according to variation to variation of the engine load and a second component derived depending upon tendency of richer side or leaner side air/fuel ratio control depending upon distribution of richer side variation and leaner side variation of given number of the second correction coefficients updated by the sixth means in most recent given updating cycles. In the alternative, the seventh means may derive the altitude dependent correction value constituting a first component variable according to variation to variation of the engine load and a second component derived depending upon tendency of richer side or leaner side air/fuel ratio control depending upon distribution of the second correction values residing richer side and leaner side of a predetermined threshold value.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

Figure 1:
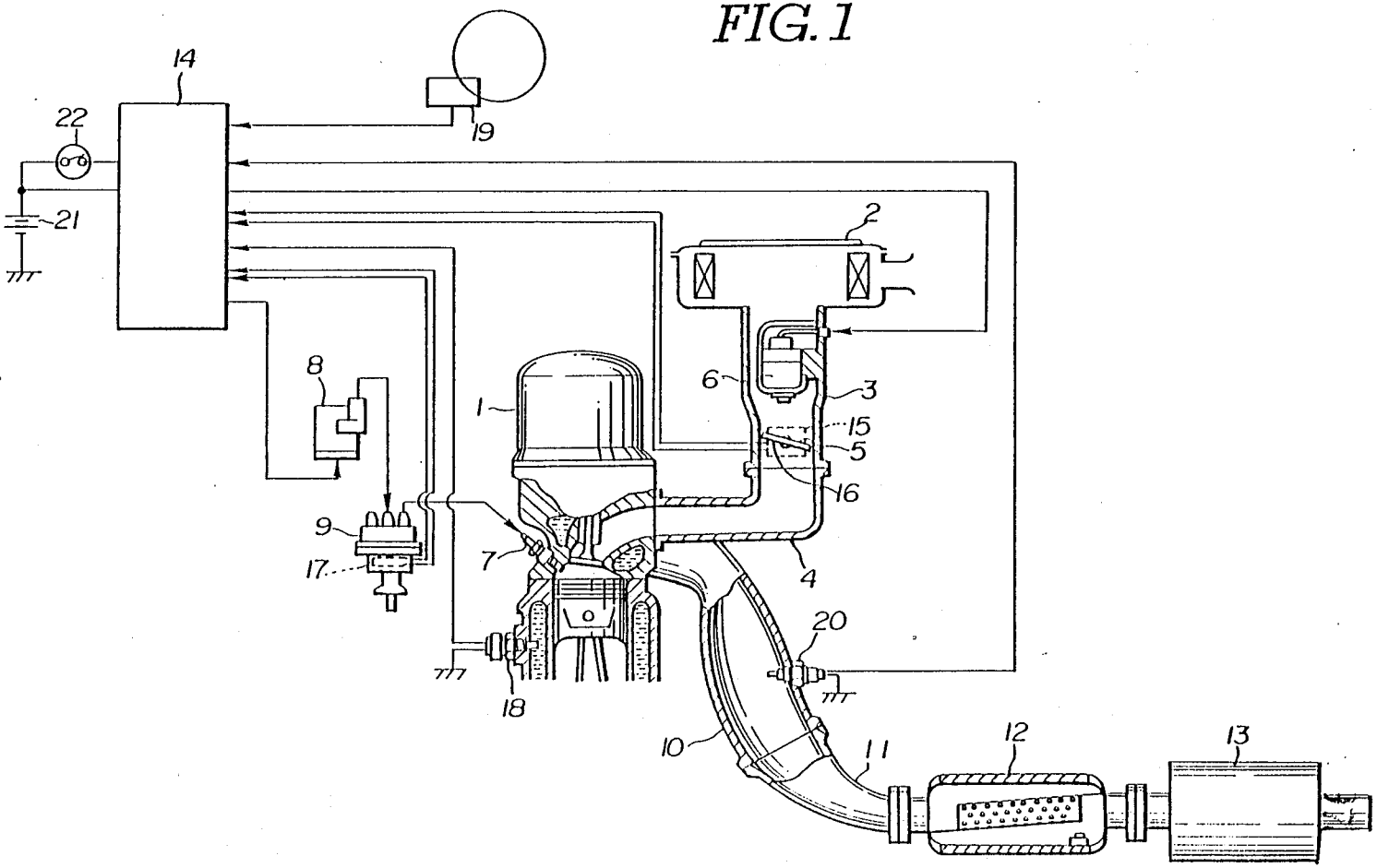
FIG. 1 is a diagram of the preferred embodiment of a learning air/fuel ratio control system according to the invention.
Figure 2:
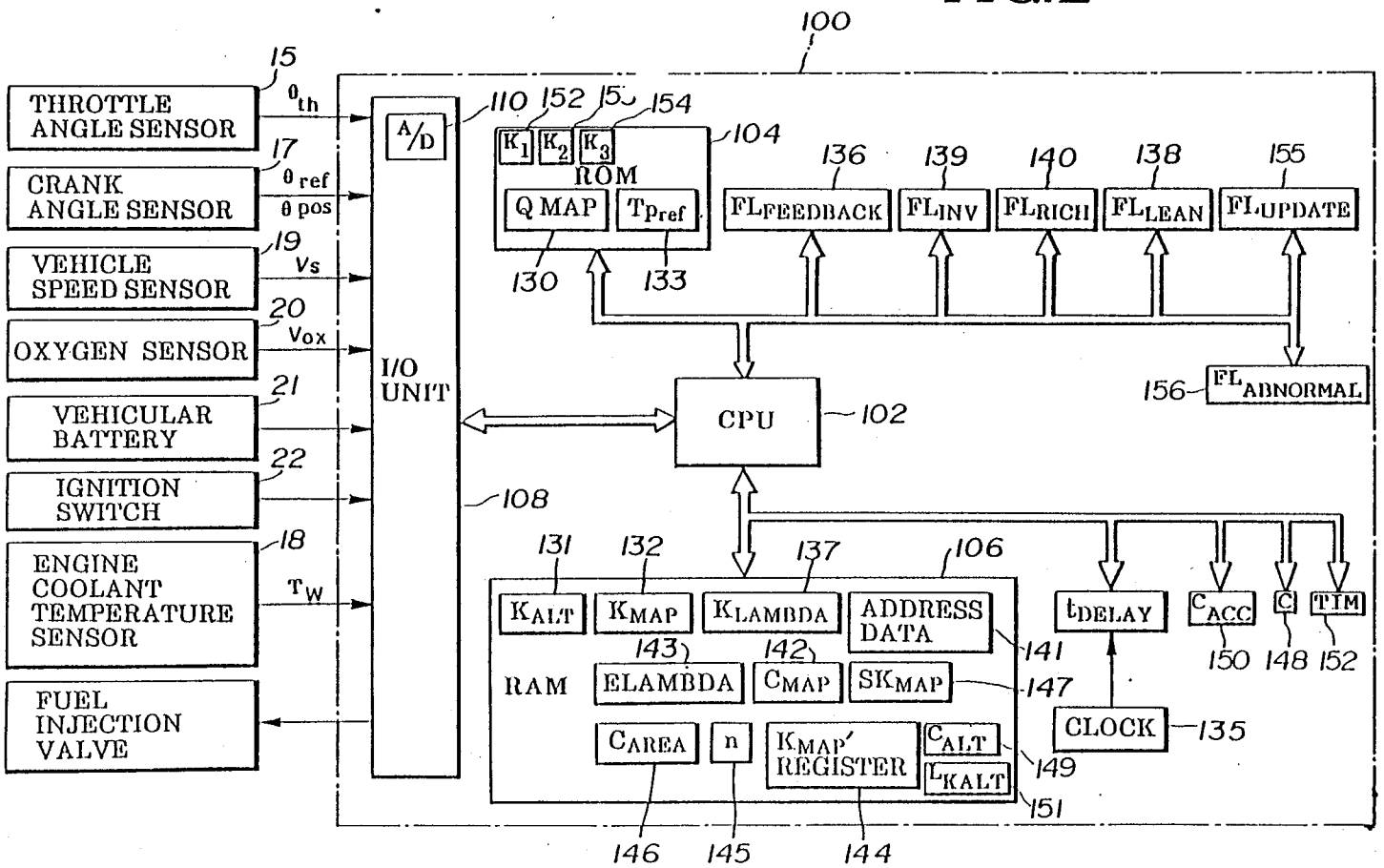
FIG. 2 is a block diagram of a control unit employed in the preferred embodiment of the air/fuel ratio control system of the invention.

Referring now to the drawings, particularly to FIGS. 1 and 2, the preferred embodiment of an air/fuel ratio control system, according to the invention, is applied to a fuel injection internal combustion engine which is generally represented by the reference numeral "1". The engine 1 has an air induction system including an air cleaner 2, a throttle body 3 and an intake manifold 4. A throttle valve 5 is disposed within the throttle body 3 for adjusting induction rate of an air/fuel mixture.

In the shown embodiment, a fuel injection valve 6 is disposed within the throttle body 3 and upstream of the throttle valve 5. Therefore, the air/fuel mixture is formed at the position in the induction system upstream of the throttle valve. The air/fuel mixture flows through the throttle body 3 and introduced into an engine combustion chamber via the intake manifold 4 and an intake port which is open and closed by means of an intake valve.

The air/fuel mixture introduced into the engine combustion chamber is combustioned by spark ignition taken place by means of an ignition plug 7 which receives an ignition power from an ignition coil unit 8 via a distributor 9.

The engine 1 also has an exhaust system including an exhaust manifold 10, an exhaust duct 11, a catalytic converter unit 12 and a muffler 13.

In order to monitor the angular position of the throttle valve 5, a throttle angle sensor 15 is associated with the throttle valve 5 to produce a throttle angle indicative signal $\theta_{th}$ having a value indicative of the monitored throttle angle. In practice, the throttle angle sensor 15 comprises a potentiometer producing analog form throttle angle indicative signal having a voltage variable depending upon the throttle valve angular position. Also, an an engine idling condition detector switch 16 is associated with the throttle valve 5 for detecting fully closed or approximately fully closed position of the throttle valve. The engine idling condition detector switch 16 outputs an engine idling condition indicative signal IDL which is held LOW level while the throttle valve 5 is not in fully closed or approximately fully closed position and is held HIGH level while the throttle valve is maintained at fully closed or approximately fully closed position.

A crank angle sensor 17 is coupled with the distributor 9 for monitoring a crank shaft angular position. For this, the crank angle sensor 17 has a rotary disc which is so designed as to rotate synchroneously with rotation of a rotor of the distributor. The crank angle sensor 17 produces a crank reference signal $\theta_{ref}$ at each of predetermined angular position and a crank position signal $\theta_{pos}$ at every time of predetermined angle of angular displacement of the crank shaft. In practice, the crank reference signal is generated every time the crank shaft is rotated at an angular position corresponding on 70° or 66° before top-dead-center (BTDC) in compression stroke of one of engine cylinder. Therefore, in case of the 6-cylinder engine, the crank reference signal $\theta_{ref}$ is produced at every 120° of the crank shaft angular displacement. On other hand, the crank position $\theta_{pos}$, is generated every given angular displacement, i.e. 1° or 2°, of the crank shaft.

An engine coolant temperature sensor 18 is disposed within an engine cooling chamber to monitor a temperature of an engine coolant filled in the cooling chamber. The engine coolant temperature sensor 18 is designed for monitoring the temperature of the engine coolant to produce an engine coolant temperature indicative signal Tw. In practice, the engine coolant temperature sensor 18 produces an analog form signal having a voltage variable depending upon the engine coolant temperature condition. A vehicle speed sensor 19 monitors a vehicle speed for producing a vehicle speed indicative signal Vs. Furthermore, the shown embodiment of the air/fuel ratio control system includes an oxygen sensor 20 disposed in the exhaust manifold 10. The oxygen sensor 20 monitors oxygen concentration contained in the exhaust gas to produce an oxygen concentration indicative signal $V_{ox}$ indicative of the monitored oxygen concentration. The oxygen concentration indicative signal $V_{ox}$ is a voltage signal variable of the voltage depending upon the oxygen concentration. In practice, the voltage of the oxygen concentration indicative signal varies across a zero voltage depending on rich and lean of the air/fuel ratio relative to a stoichiometric value.

In addition, the preferred embodiment of the air/fuel ratio control system, according to the invention, has a control unit 100 which comprises a microprocessor. The control unit 100 is connected to a vehicular battery 21 to receive power supply therefrom. An ignition switch 22 is interposed between the control unit 100 and the vehicular battery 21 to establish and block power supply.

As shown in FIG. 2, the control unit 100 comprises CPU 102, RAM 104, ROM 106 and an input/output unit 108. The input/output unit 108 has an analog-to-digital converter 110 for converting analog inputs, such as the throttle angle indicative signal $\theta_{th}$, the engine coolant temperature indicative signal Tw and so forth, into digital signals.

The control unit 100 receives the throttle angle indicative signal $\theta_{th}$, the engine idling position indicative signal IDL, the crank reference signal $\theta_{ref}$, the crank position signal $\theta_{pos}$, the engine coolant temperature indicative signal Tw, the vehicle speed indicative signal Vs and oxygen concentration indicative signal $V_{ox}$. The control unit 100 derives an engine revolution speed data N on the basis of a period of the crank reference signal $\theta_{pos}$. Namely, the period of the crank reference signal $\theta_{ref}$ is inversely proportional to the engine speed, the engine speed data N can be derived from reciprocal of the period of the crank reference signal $\theta_{re}$. Also, the control unit 100 projects an intake air flow amount indicative data Q on the basis of the throttle angle position indicative signal value $\theta_{th}$.

Although the shown embodiment projects the intake air flow rate indicative data Q based on the throttle angle position indicative signal, it is, of course, possible to obtain the air flow rate indicative data Q directly by a known air flow meter. In the alternative, the intake air flow rate indicative data may also be obtained from intake vaccum pressure which may be monitored by a vaccum sensor to be disposed within the induction system.

Generally, the control unit 100 derives a basic fuel injection amount or a basic fuel injection pulse width Tp on the basis of the engine speed data N and the intake air flow rate indicative data Q which serves to represents an engine load. The basic fuel injection amount Tp is corrected by a correction factors derived on the basis of the engine coolant temperature Tw, the rich/lean mixture ratio indicative oxygen concentration indicative signal $V_{ox}$ of the oxygen sensor 20, a battery voltage and so forth, and an enrichment factor, such as engine start up enrichment factor, acceleration enrichment factor. The fuel injection amount modified with the correction factors and enrichment factors set forth above, is further corrected by a air/fuel ratio dependent correction coefficient derived on the basis of the oxygen concentration indicative signal $V_{ox}$ for adjusting the air/fuel ratio toward the stoichiometric value.

The practical operation to be performed in the control unit 100 of the preferred embodiment of the air/fuel ratio control system according to the invention, will be discussed herebelow with reference to FIGS. 3 to 9. In the following discussion, components of the control unit 100 which are not discussed in the preceding disclosure will be discussed with the functions thereof.

Figure 3:
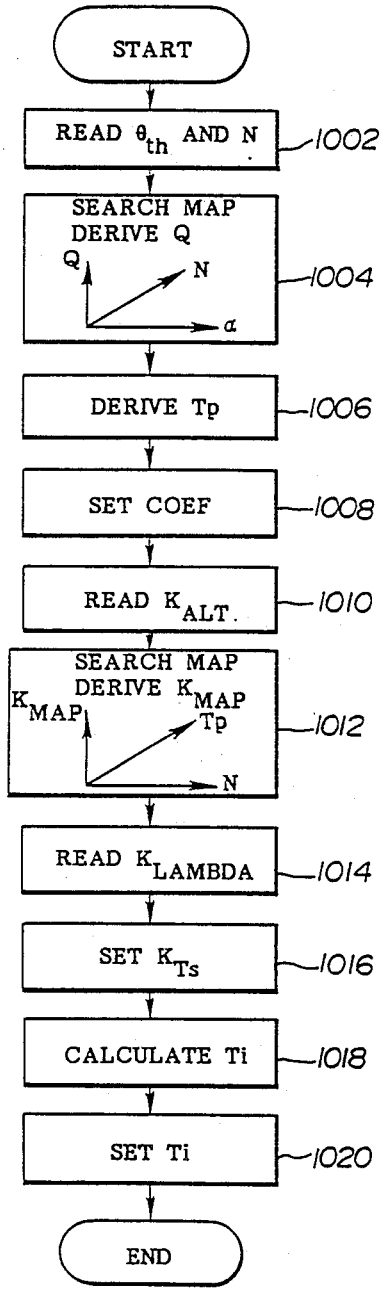
FIG. 3 is a flowchart of a routine for deriving and setting a fuel injection pulse width representative of a fuel injection amount.

FIG. 3 shows a flowchart of a fuel injection pulse setting routine for setting a fuel injection pulse width Ti in the input/output unit 108 of the control unit 100. The fuel injection pulse width Ti setting routine may be triggered at every given timing for updating fuel injection pulse width data Ti in the input/output unit 108.

At a step 1002, the throttle angle indicative signal value $\theta_{th}$ and the engine speed data N are read out. With the throttle angle indicative signal value $\theta_{th}$ and the engine speed data N as read at the step 1002, search is performed against an intake air flow rate map stored in a memory block 130 of ROM 104 to project an intake air flow rate indicative data Q, which map will be hereafter referred to as "Q map", at a step 1004.

In practice, the Q map contains various intake flow rate indicative data Q, each of which data is accessible in terms of the throttle angle indicative signal value $\theta_{th}$ and the engine speed data N. Each of the intake air flow rate indicative data Q is determined through experimentation. Relationship between the throttle angle indicative data $\theta_{th}$, the engine speed data N and the intake air flow rate Q is as shown in the block representing the step 1004.

Based on the engine speed data N as read at the step 1002 and the intake air flow rate indicative data Q as projected at the step 1004, the basic fuel injection amount Tp is derived at a step 1006. Practically, the basic fuel injection amount Tp can be calculated by the following equation:

$$Tp = K \times Q/N$$

where K is constant

At a step 1008, correction coefficients COEF is set. In practice, the correction coefficient COEF to be set here is constituted by an engine coolant temperature dependent component which will be hereafter referred to as "Tw correction coefficient", an engine start-up acceleration enrichment component which will be hereafter referred to as "start-up enrichment correction coefficient", an acceleration enrichment component which will be hereafter referred to as "acceleration enrichment correction coefficient" and so forth. The Tw correction coefficient may be derived on the basis of the engine coolant temperature indicative signal Tw. The start-up enrichment correction coefficient may be derived in response to the ignition switch operated to a cranking position. In addition, the acceleration enrichment correction coefficient can be derived in response to an acceleration demand which may be detected from variation of the throttle angle indicative signal values. Manner of derivation of these correction coefficients are per se well known and unnecessary to be discussed in detail.

At a step 1010, a correction coefficient $K_{ALT}$ is read out. The correction coefficient $K_{ALT}$ is stored in a given address of memory block 131 in RAM 106 and continuously updated through learning process. This correction coefficient will be applicable for air/fuel ratio control for maintaining the air/fuel ratio of the air/fuel mixture at a stoichiometric value at any engine driving range. Therefore, the correction coefficient $K_{ALT}$ will be hereafter referred to as "air density dependent uniform correction coefficient". Furthermore, address of the memory block 131 storing the air density dependent uniform correction coefficient $K_{ALT}$ will be hereafter referred to as "$K_{ALT}$ address". At the initial stage before learning, the air density dependent uniform correction coefficient $K_{ALT}$ is set at a value "0". After the process at the step 1010, a correction coefficient $K_{MAP}$ is determined by map search in terms of the engine speed indicative data N and the basic fuel injection amount Tp, at a step 1012. In the process of map search, the engine speed indicative data N and the basic fuel injection amount Tp are used as parameters identifying the engine driving range.

A map containing a plurality of mutually distinct correction coefficients $K_{MAP}$ is stored in a block 132 RAM 106. This map will be hereafter referred to as "$K_{MAP}$ map". The $K_{MAP}$ map storing memory block 132 is constituted by a plurality of memory addresses each storing individual correction coefficient $K_{MAP}$. Each memory block storing individual correction coefficient $K_{MAP}$ is identified by known address which will be hereafter referred to as "$K_{MAP}$ address". The $K_{MAP}$ address to be accessed is identified in terms of the engine speed indicative data N and the basic fuel injection amount Tp. The correction coefficient $K_{MAP}$ stored in each $K_{MAP}$ address is determined in relation to the engine driving range defined by the engine speed data N and the fuel injection amount Tp and continuously updated through learning process. Therefore, this correction coefficient $K_{MAp}$ will be hereafter referred to as "driving range based learned correction coefficient". The $K_{MAP}$ map is formed by setting the engine speed data N in x-axis and the basic fuel injection amount Tp in y-axis. The x-axis component is divided into a given number $n_N$ of engine speed ranges. Similarly, the y-axis component is divided into a given number $n_{Tp}$ of basic fuel injection ranges. Therefore, the $K_{MAP}$ map is provided $(n_N \times n_{Tp})$ addresses. Practically, the x-axis component and y-axis component are divided into 8 ranges respectively. Therefore, 64 $(8 \times 8)$ addresses are formed to store the driving range based learned correction coefficient respectively.

It should be noted that each $K_{MAP}$ address in the $K_{MAP}$ initially stores a value "0" before learning process is initiated.

At a step 1014, a feedback correction coefficient $K_{LAMBDA}$ is read out. Process of derivation of the feedback correction coefficient $K_{LAMBDA}$ will be discussed later with reference to FIG. 6. At a step 1016, a battery voltage dependent correction value Ts is set in relation to a voltage of the vehicular battery 21.

Based on the basic fuel injection amount Tp derived at the step 1006, the correction coefficient coefficient COEF derived at the step 1008, the air density dependent uniform correction coefficient $K_{ALT}$ read at the step 1010, the driving range based learned correction coefficient $K_{MAP}$ derived at the step 1012, the feedback correction coefficient $K_{LAMBDA}$ read at the step 1014 and the battery voltage dependent correction value Ts set at the step 1016, a fuel injection amount Ti is calculated at a step 1018 according to the following equation:

$$Ti = Tp \times COEF \times (K_{LAMBDA} + K_{ALT} + K_{MAP}) + Ts$$

A fuel injection pulse width data corresponding to the fuel injection amount Ti derived at the step 1018, which will be hereafter referred to as "Ti data", is set in the input/out unit 108.

Figure 4:
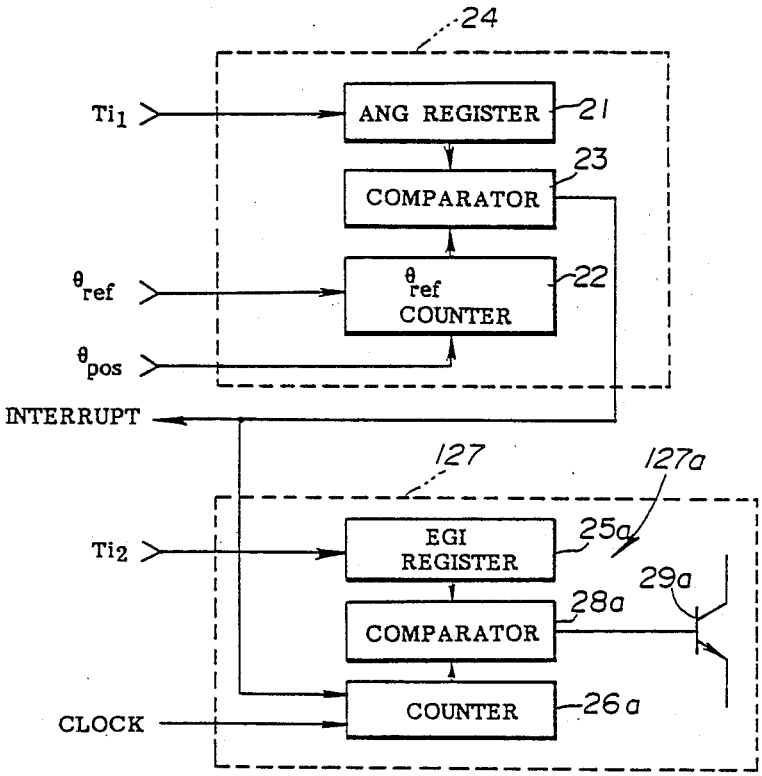
FIG. 4 is a block diagram of an input/output unit in the control unit to be employed in the preferred embodiment of the air/fuel ratio control system of FIG. 2.

FIG. 4 shows one example of construction of part of the input/output unit 108 which is used for controlling fuel injection timing and fuel injection amount according to the set Ti data.

FIG. 4 shows detailed construction of the relevant section of the input/output unit 108. The input/output unit 108 has a fuel injection start timing control section 124. The fuel injection start timing control section 124 has an angle (ANG) register 121, to which a fuel injection start timing derived by CPU during process of fuel injection control data, e.g. the air flow rate, throttle angle position, the engine speed and so forth. The fuel injection start timing control section 124 also has a crank position signal counter 122. The crank position signal counter 122 is designed to count up the crank position signals θpos and to be reset in response to the crank reference signal $\theta_{ref}$. A comparator 123 is also provided in the fuel injection start timing control section 124. The comparator 123 compares the fuel injection start timing indicative value set in the ANG register 121 and the crank position signal counter value in the counter 122. The comparator 123 outputs HIGH level comparator signal when the crank position signal counter value becomes the same as that of the fuel injection start timing indicative value. The HIGH level comparator signal of the comparator 123 is fed to a fuel injection pulse output section 127.

The fuel injection pulse output section 130 has a fuel injection pulse generator 127*a*. The fuel injection pulse generator 127*a* comprises a fuel injection (EGI) register 125, a clock counter 126, a comparator 128 and a power transistor 129. A fuel injection pulse width data which is determined through data processing during execution of fuel injection control program to be discussed later, is set in the EGI register 125.

The output of the comparator 123 is connected to the clock counter 126. The clock counter 126 is responsive to the leading edge of HIGH level output of the comparator to be reset. On the other hand, the clock counter 126 is connected to a clock generator 112 in the control unit 100 to receive therefrom a clock pulse. The clock counter 126 counts up the clock pulse as triggered by the HIGH level gate signal. At the same time, the comparator 128 is triggered in response to resetting of the clock counter 126 to output HIGH level comparator signal to the base electrode of the power transistor 129. The power transistor 129 is thus turned ON to open the fuel injection valve 6 to perform fuel injection.

When the counter value of the clock counter 126 reaches the fuel injection pulse width value set in the EGI register 125, the comparator signal of the comparator 128 turns into LOW level to turn OFF the power transistor 129. By turning OFF of the power transistor 129, the fuel injection valve 4 closes to terminate fuel injection.

The ANG register 121 in the fuel injection start timing control section 124 updates the set fuel injection start timing data at every occurrence of the crank reference signal $\theta_{ref}$.

With this arrangement, fuel injection starts at the timing set in the ANG register 121 and is maintained for a period as set in the EGI register 125. By this, the fuel injection amount can be controlled by adjusting the fuel injection pulse width.

Figure 5:
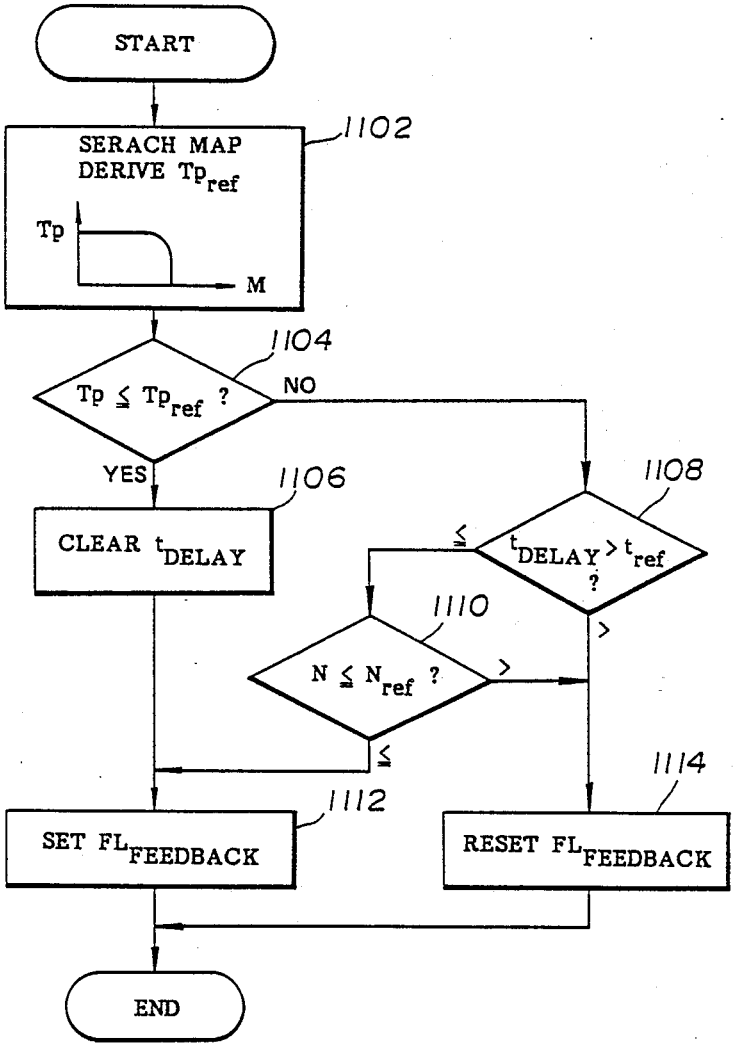
FIG. 5 is a flowchart of a routine for discriminating engine operating condition for governing control operation mode between FEEDBACK control mode and OPEN LOOP control mode.

FIG. 5 shows a routine governing control mode to switch the mode between FEEDBACK control mode and OPEN LOOP control mode based on the engine driving condition. Basically, FEEDBACK control of air/fuel ratio is taken place while the engine is driven under load load and at low speed and OPEN LOOP control is performed otherwise. In order to selectively perform FEEDBACK control and OPEN LOOP control, the basic fuel injection amount Tp is taken as a parameter for detecting the engine driving condition. For distinguishing the engine driving condition, a map containing FEEDBACK condition indicative criteria $Tp_{ref}$ is set in a memory block 133 of ROM 104. The map is designed to be searched in terms of the engine speed N, at a step 1102. The FEEDBACK condition indicative criteria set in the map are experimentarily obtained and define the engine driving range to perform FEEDBACK control, which engine driving range is explanatorily shown by the hatched area of the map illustrated within the process block 1102 of FIG. 5.

At a step 1104, the basic fuel injection amount Tp derived in the process of the step 1006 is then compared with the FEEDBACK condition indicative criterion $Tp_{ref}$, at a step 1104. When the basic fuel injection amount Tp is smaller than or equal to the FEEDBACK condition indicative criterion $T_{pref}$ as checked at the step 1104, a delay timer 134 in the control unit 100 and connected to a clock generator 135, is reset to clear a delay timer value $t_{DELAY}$, at a step 1106. On the other hand, when the basic fuel injection amount Tp is greater than the FEEDBACK condition indicative criterion $Tp_{ref}$ as checked at the step 1104, the delay timer value $t_{DELAY}$ is read and compared with a timer reference value $t_{ref}$, at a step 1108. If the delay timer value $t_{DELAY}$ is smaller than or equal to the timer reference value $t_{ref}$, the engine speed data N is read and compared with an engine speed reference $N_{ref}$, at a step 1110. The engine speed reference $N_{ref}$ represents the engine speed criterion between high engine speed range and low engine speed range. Practically, the engine speed reference $N_{ref}$ is set at a value corresponding to a high/low engine speed criteria, e.g. 3800 r.p.m. When the engine speed indicative data N is smaller than the engine speed reference $N_{ref}$, or after the step 1106, a FEEDBACK condition indicative flag $FL_{FEEDBACK}$ which is to be set in a flag register 136 in the control unit 100, is set at a step 1112. When the delay timer value $t_{DELAY}$ is greater than the timer reference value $t_{ref}$, a FEEDBACK condition indicative flag $FL_{FEEDBACK}$ is reset, at a step 1114. After one of the step 1112 and 1114, process goes END and is returned to a background job which governs execution of various routines.

By providing the delay timer to switch mode of control between FEEDBACK control and OPEN LOOP control, hunting in selection of the control mode can be successfully prevented. Furthermore, by providing the delay timer for delaying switching timing of control mode from FEEDBACK control to OPEN LOOP mode, FEEDBACK control can be maintained for the period of time corresponding to the period defined by the timer reference value. This expands period to perform FEEDBACK control and to perform learning.

For example, during hill or mountain climbing, FEEDBACK control can be maintained for the given period corresponding to the set delay time to learning of correction coefficient for adapting the air/fuel ratio to the air density even though the engine driving condition is in transition state.

Figure 6:
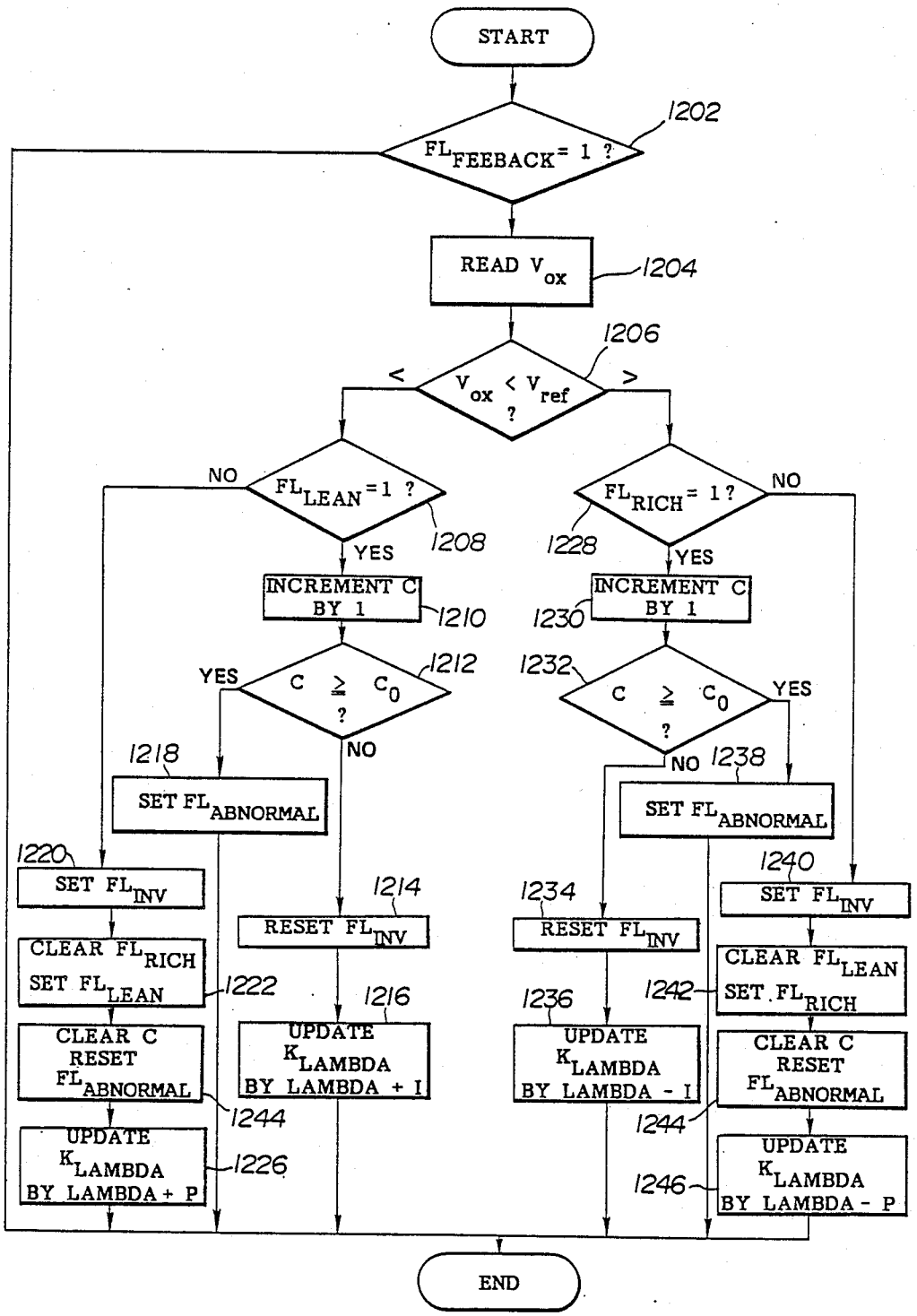
FIG. 6 is a flowchart of a routine for deriving feedback correction coefficient composed of a proportional component and an integral component.

FIG. 6 shows a routine for deriving the feedback correction coefficient $K_{LAMBDA}$. The feedback correction coefficient $K_{LAMBDA}$ is composed of a proportional (P) component and an integral (I) component. The shown routine is triggered every given timing, i.e. every 10 ms., in order to regularly update the feedback control coefficient $K_{LAMBDA}$. The feedback control coefficient $K_{LAMBDA}$ is stored in a memory block 137 and cyclically updated during a period in which FEEDBACK control is performed.

At a step 1202, the FEEDBACK condition indicative flag $FL_{FEEDBACK}$ is checked. When the FEEDBACK condition indicative flag $FL_{FEEDBACK}$ is not set as checked at the step 1202, which indicates that the ongoing control mode is OPEN LOOP. Therefore, process directly goes END. At this occasion, since the feedback correction coefficient $K_{LAMBDA}$ is not updated, the content in the memory block 137 storing the feedback correction coefficient is held in unchanged.

When the FEEDBACK condition indicative flag $FL_{FEEDBACK}$ is set as checked at a step 1202, the oxygen concentration indicative signal $V_{ox}$ from the oxygen sensor 20 is read out at a step 1204. The oxygen concentration indicative signal value $V_{ox}$ is then compared with a predetermined rich/lean criterion $V_{ref}$ which corresponding to the air/fuel ratio of stoichiometric value, at a step 1206. In practice, in the process, judgment is made that the air/fuel mixture is lean when the oxygen concentration indicative signal value $V_{ox}$ is smaller than the rich/lean criterion $V_{ref}$, a lean mixture indicative flag $FL_{LEAN}$ which is set in a lean mixture indicative flag register 138 in the control unit 100, is checked at a step 1208.

On the other hand, when the lean mixture indicative flag $FL_{LEAN}$ is set as checked at the step 1208, a counter value C of a faulty sensor detecting timer 148 in the control unit 100 is incremented by one (1), at a step 1210. The counter value C will be hereafter referred to as "faulty timer value". The, the faulty timer value C is compared with a preset faulty timer criterion $C_0$ which represents acceptable maximum period of time to maintain lean mixture indicative $O_2$ sensor signal while the oxygen sensor 20 operates in normal state, at a step 1212. When the faulty timer value C is smaller than the faulty timer criterion $C_0$, the rich/lean inversion indicative flag $FL_{INV}$ is reset at a step 1214. Thereafter, the feedback correction coefficient $K_{LAMBDA}$ is updated by adding a given integral constant (I constant), at a step 1216. On the other hand, when the faulty timer value C as checked at the step 1212 is greater than or equal to the faulty timer criterion $C_0$, a faulty sensor indicative flag $FL_{ABNORMAL}$ is set in a flag register 156 at a step 1218. After setting the faulty sensor indicative flag $FL_{ABNORMAL}$ process goes END.

On the other hand, when the lean mixture indicative flag $FL_{LEAN}$ is not set as checked at the step 1208, fact of which represents that the air/fuel mixture ratio is adjusted changed from rich to lean, an rich/lean inversion indicative flag $FL_{INV}$ which is set in a flag register 139 in the control unit 100, is set at a step 1220. Thereafter, a rich mixture indicative flag $FL_{RICH}$ which is set in a flag register 139, is reset and the lean mixture indicative flag $FL_{LEAN}$ is set, at a step 1222. Thereafter, the faulty timer value C in the faulty sensor detecting timer 148 is reset and the faulty sensor indicative flag $FL_{ABNORMAL}$ is reset, at a step 1224. Then, the feedback correction coefficient $K_{LAMBDA}$ is modified by adding a proportional constant (P constant), at a step 1226.

On the other hand, when the oxygen concentration indicative signal value $V_{ox}$ is greater than the rich/lean criterion $V_{ref}$ as checked at the step 1206, a rich mixture indicative flag $FL_{RICH}$ which is set in a rich mixture indicative flag register 141 in the control unit 100, is checked at a step 1228.

When the rich mixture indicative flag $FL_{RICH}$ is set as checked at the step 1228, the counter value C of the faulty sensor detecting timer 148 in the control unit 100 is incremented by one (1), at a step 1230. The, the faulty timer value C is compared with the preset faulty timer criterion $C_0$, at a step 1232. When the faulty timer value C is smaller than the faulty timer criterion $C_0$, the rich/lean inversion indicative flag $FL_{INV}$ is reset at a step 1234. Thereafter, the feedback correction coefficient $K_{LAMBDA}$ is updated by subtracting the I constant, at a step 1236.

On the other hand, when the faulty timer value C as checked at the step 1232 is greater than or equal to the faulty timer criterion $C_0$, a faulty sensor indicative flag $FL_{ABNORMAL}$ is set at a step 1238. After setting the faulty sensor indicative flag $FL_{ABNORMAL}$ process goes END.

When the rich mixture indicative flag $FL_{RICH}$ is not set as checked at the step 1228, fact of which represents that the air/fuel mixture ratio is just changed from lean to rich, an rich/lean inversion indicative flag $FL_{INV}$ which is set in a flag register 139 in the control unit 100, is set at a step 1240. Thereafter, a rich mixture indicative flag $FL_{LEAN}$ is reset and the rich mixture indicative flag $FL_{RICH}$ is set, at a step 1242. Thereafter, the faulty timer value C in the faulty sensor detecting timer 148 is reset and the faulty sensor indicative flag $FL_{ABNORMAL}$ is reset, at a step 1244. Then, the feedback correction coefficient $K_{LAMBDA}$ is modified by subtracting the P constant, at a step 1246.

After one of the process of the steps 1216, 1218, 1226, 1236, 1238 and 1246, process goes to the END.

It should be noted that, in the shown embodiment, the P component is set at a value far greater than that of I component.

Figure 7:
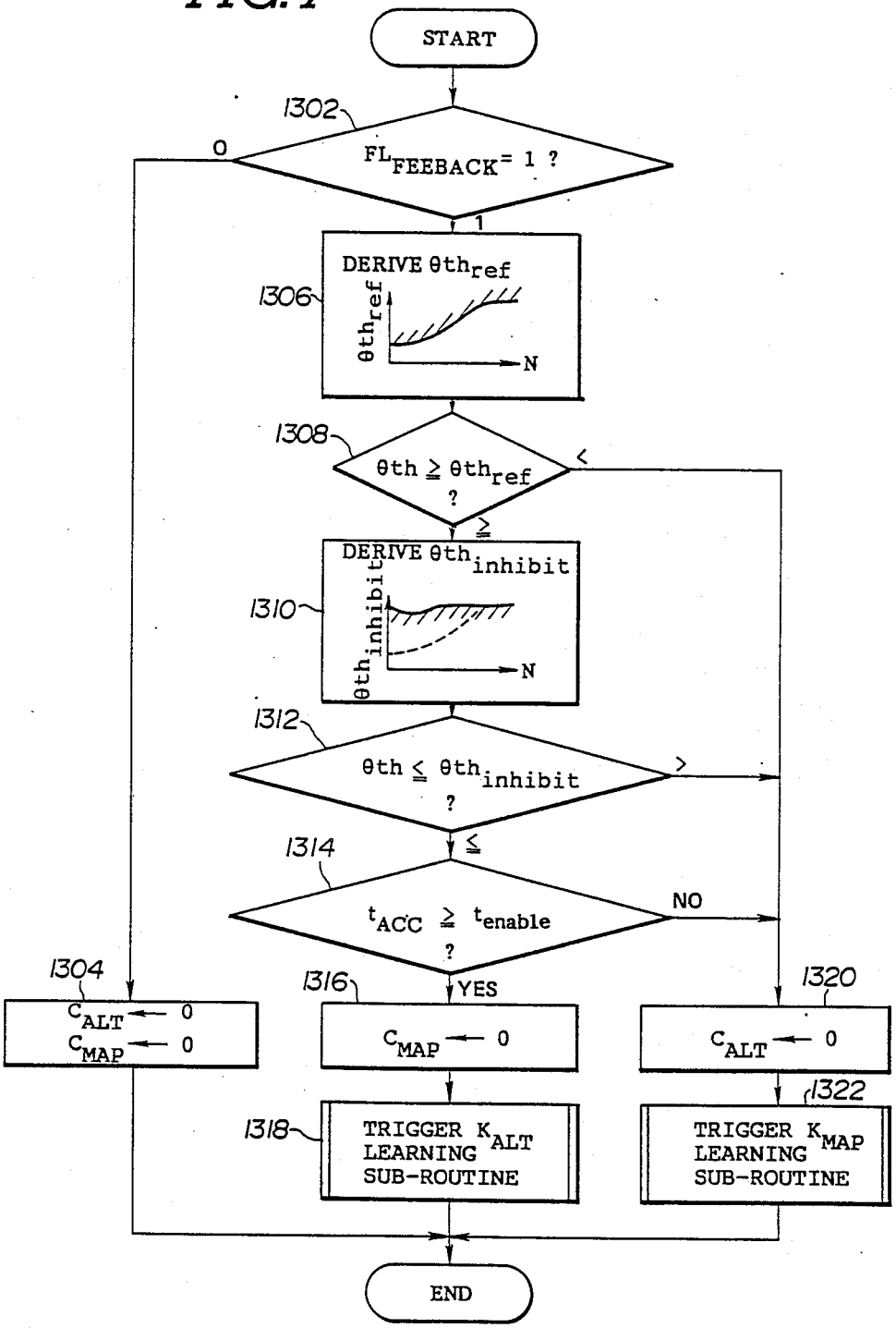
FIG. 7 is a flowchart of a learning governing routine for governing learning of $K_{ALT}$ and $K_{MAP}$.

FIG. 7 shows a learning governing routine for selectively updating air density dependent uniform correction coefficient $K_{ALT}$ and the driving range based learned correction coefficient $K_{MAP}$. Since learning of the correction coefficients $K_{ALT}$ and $K_{MAP}$ can be performed only when the FEEDBACK control is performed. The FEEDBACK condition indicative flag $FL_{FEEDBACK}$ is checked at a step 1302. When the FEEDBACK condition indicative flag $FL_{FEEDBACK}$ is not set as checked at the step 1302, a $K_{ALT}$ learning cycle counter value $C_{ALT}$ in a $K_{ALT}$ counter 149 in RAM 106 and a $K_{MAP}$ learning cycle counter value $C_{MAP}$ in a $K_{MAP}$ counter 142 are cleared at a step 1304 and thereafter process goes END.

On the other hand, when the FEEDBACK condition indicative flag $FL_{FEEDBACK}$ as checked at the step 1302 is set, a throttle angle reference value $\theta th_{ref}$ is derived on the basis of the engine speed data N, at a step 1306. The throttle angle reference value $\theta th_{ref}$ is set in a form of a table data to be read in terms of the engine speed N. Each value of the throttle angle reference value $\theta th_{ref}$ is representative of high engine load condition criteria at respective engine speed range, above which the intake air flow rate Q is held unchanged. Namely, when the throttle angle position $\theta_{th}$ is greater than or equal to the throttle angle reference value $\theta th_{ref}$, the air flow rate is held substantially unchanged. In such engine driving condition, air density dependent uniform correction coefficient $K_{ALT}$ is to be updated. The throttle angle reference value $\theta th_{ref}$ will be hereafter referred to as "Q flat range threshold".

At a step 1308, the throttle angle indicative signal value $\theta$this compared with the Q flat range threshold $\theta th_{ref}$ derived at the step 1306. If the throttle angle indicative signal value $\theta$this greater than or equal to the Q flat range threshold $\theta th_{ref}$, another throttle angle reference value $\theta th_{inhibit}$ is derived in terms of the engine speed data N at a step 1310. In the practice, the throttle angle reference value $\theta th_{inhibit}$ represents substantially high engine load range where flow velocity of the intake is lowered to make distribution of the air/fuel mixture worse. This may cause substantial fluctuation of the air/fuel ratio to cause significant variation of the oxygen concentration indicative signal value $V_{ox}$.

Therefore, when the throttle angle indicative signal value $\theta_{th}$ is greater than or equal to this throttle angle reference value $\theta th_{inhibit}$, updating of the air density dependent uniform correction coefficient $K_{ALT}$ is better not to be performed. This throttle angle reference value $\theta th_{inhibit}$ as derived at the step 1310, will be hereafter referred to as "learning inhibiting threshold".

At a step 1312, the throttle angle indicative signal value $\theta_{th}$ is compared with the learning inhibiting threshold $\theta th_{inhibit}$. When the the throttle angle indicative signal value $\theta_{th}$ is smaller than or equal to the learning inhibiting threshold $\theta th_{inhibit}$, check is performed whether a timer value $t_{ACC}$ of a timer 150 in the control unit 100 is greater than or equal to a timer reference value $t_{enable}$, at a step 1314. The timer reference value $t_{enable}$ represents possible maximum period required after recovery of stability after rapid acceleration. Namely, during rapid acceleration, part of the fuel injection through the fuel injection valve 6 flows on the inner periphery of the induction passage to influence of stability of the air/fuel ratio. This peripheral flow of the fuel may be maintained even after termination of the engine acceleration. Therefore, in order to avoid influence of unstability of the air/fuel radio during the engine acceleration period and subsequent period required for stabilization, it is better not to perform learning of the air density dependent uniform correction coefficient $K_{ALT}$.

When the timer value $t_{ACC}$ is greater than or equal to the timer reference value $t_{enable}$ as compared at, the $K_{MAP}$ learning cycle counter value $C_{MAP}$ is cleared at the step 1316. Then, at a step 1318, $K_{ALT}$ learning subroutine of FIG. 8 is triggered.

Figure 9:
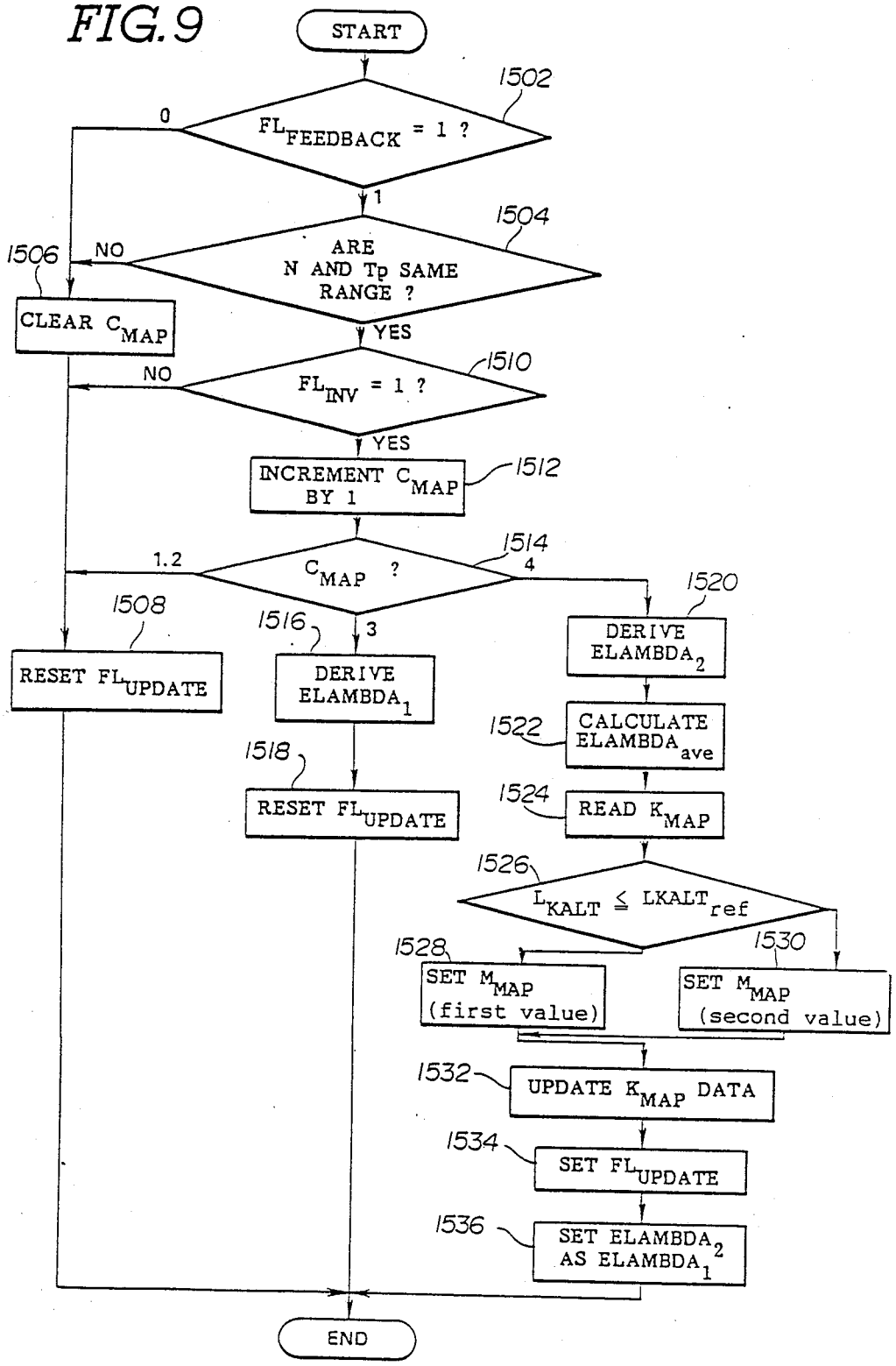
FIG. 9 is a flowchart showing a $K_{MAP}$ learning routine for updating an engine driving range based correction coefficients.

On the other hand, when the throttle angle indicative signal value $\theta_{th}$ is smaller than the Q flat range threshold $\theta th_{ref}$ as checked at the step 1308, when the throttle angle indicative signal value $\theta_{th}$ is greater than the learning inhibiting threshold $\theta th_{inhibit}$ or when the timer value $t_{ACC}$ is smaller than the timer reference value $t_{enable}$, the $K_{ALT}$ learning cycle counter value $C_{ALT}$ is cleared at a step 1320 and then a $K_{MAP}$ learning sub-routine of FIG. 9 is triggered at a step 1322.

Figure 8:
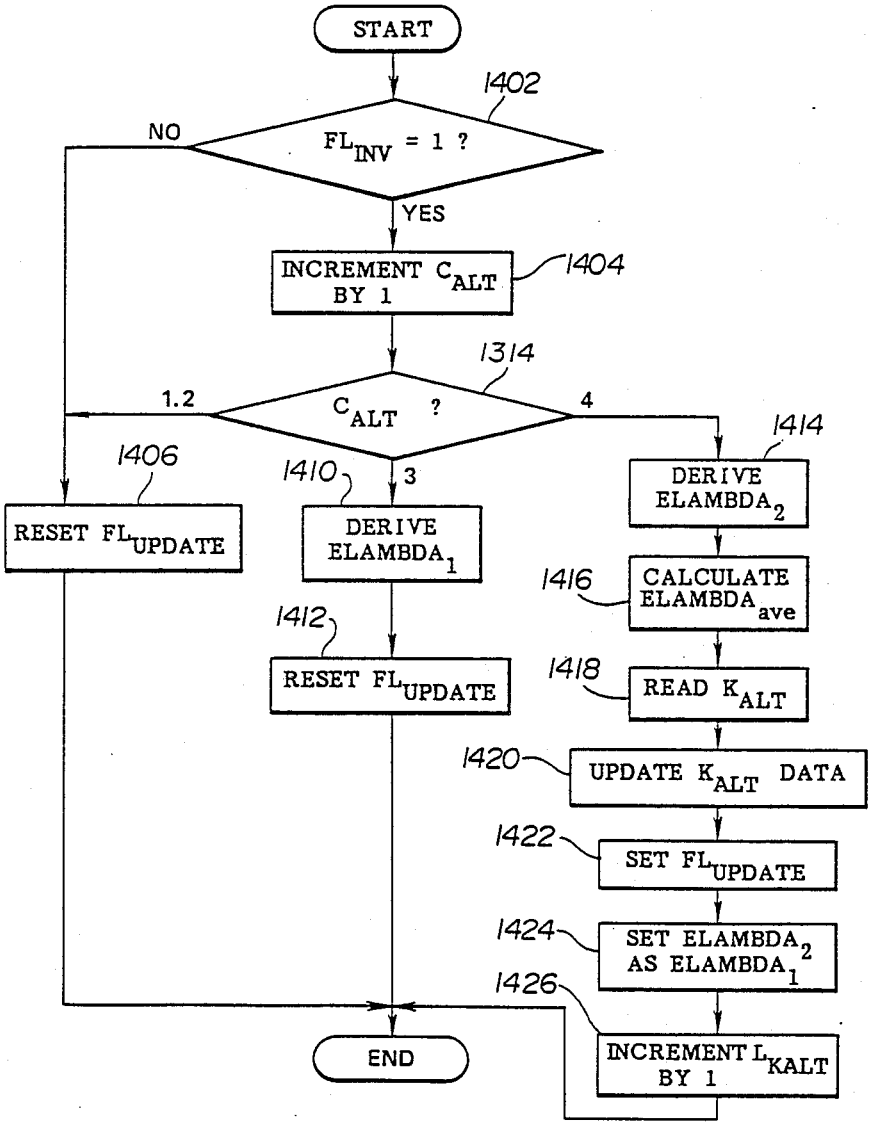
FIG. 8 is a flowchart of a $K_{ALT}$ learning routine for updating a map storing an air density dependent uniform correction coefficients.
Figure 13:
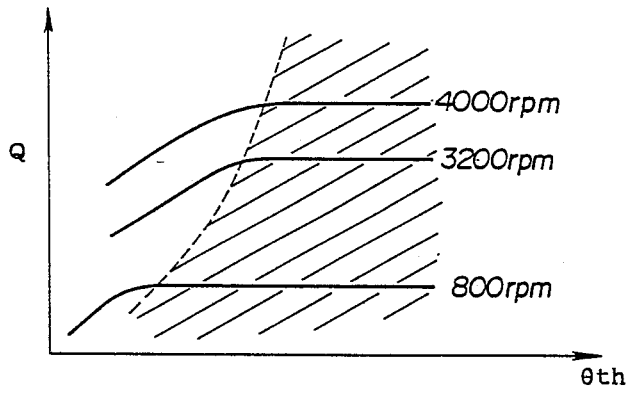
FIG. 13 is a chart showing range to perform learning of $K_{ALT}$ which is defined by throttle angular position $\theta_{th}$, intake air flow rate Q and engine speed N.

FIG. 8 shows the $K_{ALT}$ learning sub-routine to be triggered at the step 1318 of the learning governing routine of FIG. 7. Here, as will be seen from FIG. 13, $K_{ALT}$ learning is performed in the hatched area which is defined by the throttle angular position $\theta_{th}$, the intake air flow rate Q and the engine speed. In the shown embodiment, the air density dependent uniform correction coefficient $K_{ALT}$ is updated every occurrence of inversion of polarity of the oxygen concentration indicative signal $V_{ox}$. Therefore, immediately after execution of the sub-routine of FIG. 8, the rich/lean inversion indicative flag $FL_{INV}$ which is set and reset through the steps 1214, 1220, 1234 and 1244 of the routine of FIG. 6, is checked, at a step 1402, so as to detect whether inversion of the rich/lean of the air/fuel mixture occurs or not. When the rich/lean inversion indicative flag $FL_{INV}$ is not set as checked at the step 1402, an updating indicative flag $FL_{UPDATE}$ to be set in a flag register 155 of the control unit 100, is reset, at a step 1404. Thereafter, the process directly goes END and returns to the background job. On the other hand, when the rich/lean inversion indicative flag $FL_{INV}$ is set as checked at the step 1402, the $K_{ALT}$ learning cycle counter value $C_{ALT}$ is incremented by one (1) at a step 1406. Then, the $K_{ALT}$ learning cycle counter value $C_{ALT}$ is checked at a step 1408. When the $K_{ALT}$ learning cycle counter value $C_{ALT}$ is 1 or 2 as checked at the step 1408, process goes to the step 1404 to reset the updating indicative flag $FL_{UPDATE}$. Thereafter, process goes END. This is required for obtaining reliable air density dependent uniform correction coefficient $K_{ALT}$ by deriving the coefficient based on a greater number of the feedback correction coefficient $K_{LAMBDA}$.

When the $K_{ALT}$ learning cycle counter value $C_{ALT}$ is 3, a first correction coefficient error value $ELAMBDA_1$ is derived at a step 1410. The first correction coefficient error value $ELAMBDA_1$ represents a difference between the feedback correction coefficient $K_{LAMBDA}$ and a coefficient reference value $LAMBDA_{ref}$, e.g. 1, and is temporarily stored in a memory block 143 of RAM 106. After this the updating flag $FL_{UPDATE}$ is reset at a step 1412. Thereafter, process goes END.

Figure 10:
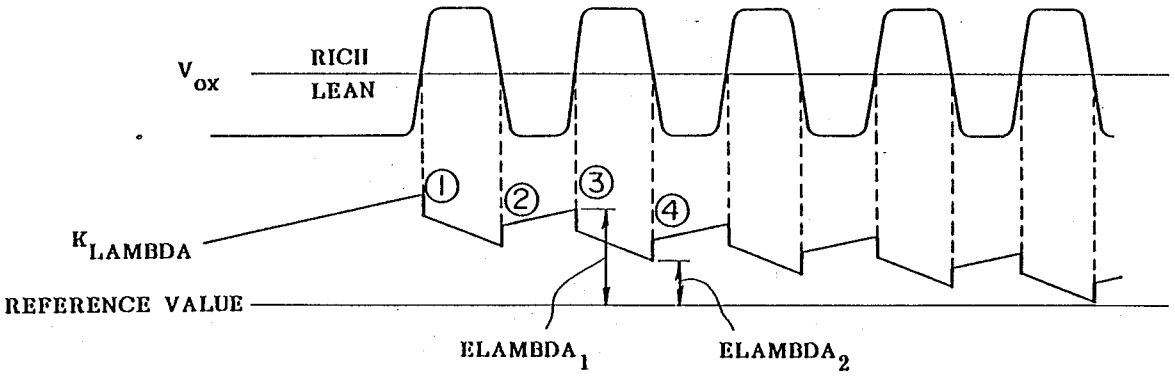
FIG. 10 is a timing chart showing operation of the preferred embodiment of the air/fuel ratio control system of the invention.

It should be appreciated that, as shown in FIG. 10, first and second correction coefficient error value $ELAMBDA_1$ and $ELAMBDA_2$ represents upper and lower peaks of difference of the feedback correction coefficient $K_{LAMBDA}$ and the reference value, which peak values appear at zero-crossing of the the oxygen concentration indicative signal value $V_{ox}$.

On the other hand, when the $K_{ALT}$ learning cycle counter value $C_{ALT}$ is greater than or equal to 4, the second correction coefficient error value $ELAMBDA_2$ is derived on the basis of the instantaneous feedback correction coefficient $K_{LAMBDA}$ and the coefficient reference value $LAMBDA_{ref}$, at a step 1412. An average value $LAMBDA_{ave}$ of the first and second correction coefficient error values $ELAMBDA_1$ and $ELAMBDA_2$ is then calculated at a step 1416.

At a step 1418, the relevant air density dependent uniform correction coefficient $K_{ALT}$ is read in terms of the engine speed data N and the basic fuel injection value Tp. Based on the average value $LAMBDA_{ave}$ derived at the step 1416, read relevant air density dependent uniform correction coefficient $K_{ALT}$ as read at the step 1418, is modified, at a step 1420. Modification of the engine driving range based correction coefficient $K_{ALT}$ is performed by:

$$K_{ALT}' = K_{ALT} + M_{ALT} \times LAMBDA_{ave}$$

where $K_{ALT}'$ is a modified correction coefficient; and $M_{ALT}$ is a constant determining the correction coefficient $K_{ALT}$ modification rate, which is set in a value range of $0 < M_{ALT} < 1$.

The modified correction coefficient $K_{ALT}'$ is temporarily stored in a temporary register 144. After the step 1420, the updating indicative flag $FL_{UPDATE}$ is set at a step 1422 and the second correction coefficient error value $ELAMBDA_2$ is set in the memory block 143 as the first correction coefficient error value $ELAMBDA_1$ for next cycle of execution, at a step 1424. Then, $K_{ALT}$ learning counter value $L_{KALT}$ in a $K_{ALT}$ learning counter 151 in RAM 106 is incremented by 1, at a step 1426. After the step 1426, process goes END.

By providing the updating counter $C_{ALT}$, updating of the correction coefficient $K_{ALT}$ in the $K_{ALT}$ map is performed only when the learning routine is repeated four cycles or more under substantially the same engine driving condition in the same engine driving range.

FIG. 9 shows a process for learning the engine driving range based learnt correction coefficient $K_{MAP}$. As set forth above, learning of the correction coefficient is performed only when the control mode is FEEDBACK mode. Therefore, at a step 1502, check is performed whether the FEEDBACK condition indicative flag $FL_{FEEDBACK}$ is set or not. If the FEEDBACK condition indicative flag $FL_{FEEDBACK}$ is set as checked at the step 1502, check is performed whether the engine speed data N and the basic fuel injection amount Tp identifies the same engine driving range as that identified in the former execution cycle, at a step 1504. In practice, check in the step 1504 is performed by comparing the address data identifying corresponding memory block in the $K_{MAP}$ map. The address data identified by the engine speed data N and the basic fuel injection amount Tp is temporarily stored in a memory block 141 of RAM 106. When FEEDBACK condition indicative flag $FL_{FEEDBACK}$ is not set as checked at the step 1502 or when the address data as compared at the step 1504 do no match with the address data stored in the memory block 141 which means that the engine speed data N and the basic fuel injection amount Tp identifies different engine driving range than that identified in the former execution cycle, an updating counter 142 in the control unit 100 is reset to clear the $K_{MAP}$ learning cycle counter value $C_{MAP}$, at a step 1506. At a step 1508, the updating indicative flag $FL_{UPDATE}$ is reset.

On the other hand, when the address data compared the address data stored in the memory block 142 matches with the latter, the inversion indicative flag $FL_{INV}$ is checked at a step 1510. When the inversion indicative flag $FL_{INV}$ not set as checked at the step 1510, process goes to the step 1508 to reset the updating indicative flag $FL_{UPDATE}$.

When the inversion indicative flag $FL_{INV}$ is set as checked at the step 1510, the $K_{MAP}$ learning cycle counter $C_{MAP}$ is incremented by 1, at a step 1512. After this, the $K_{MAP}$ learning cycle counter value $C_{MAP}$ is checked at a step 1514. This $K_{MAP}$ learning cycle counter $C_{MAP}$ serves to count up occurrence of updating of updating of the feedback correction coefficient $K_{LAMBDA}$ while the engine driving range is held in the one range.

When the $K_{MAP}$ learning cycle counter value $C_{MAP}$ is 1 or 2, process goes to the step 1508. On the other hand, when the $K_{MAP}$ learning cycle counter value $C_{MAP}$ is 3, a first correction coefficient error value $ELAMBDA_1$ is derived at a step 1516. The first correction coefficient error value ELAMBDA represents a difference between the feedback correction coefficient $K_{LAMBDA}$ and a coefficient reference value $LAMBDA_{ref}$, e.g. 1, and is temporarily stored in a memory block 143 of RAM 106. After this the updating flag $FL_{UPDATE}$ is reset at a step 1518.

After the process at the step 1508 or 1518, process goes END.

On the other hand, when the $K_{MAP}$ learning cycle counter value $C_{MAP}$ is greater than or equal to 4, a second correction coefficient error value $ELAMBDA_2$ is derived on the basis of the instantaneous feedback correction coefficient $K_{LAMBDA}$ and the coefficient reference value $LAMBDA_{ref}$, at a step 1520. An average value $LAMBDA_{ave}$ of the first and second correction coefficient error values $ELAMBDA_1$ and $ELAMBDA_2$ is then calculated at a step 1522.

At a step 1524, the engine driving range based learnt correction coefficient $K_{MAP}$ is read in terms of the engine speed data N and the basic fuel injection value Tp. At a step 1526, the $K_{ALT}$ learning counter value $L_{KALT}$ is read out from the $K_{ALT}$ learning counter 151 and compared with a $K_{ALT}$ learning threshold value $LKALT_{ref}$. When the $K_{ALT}$ learning counter value $L_{KALT}$ is greater than or equal to the $K_{ALT}$ learning threshold $LKALT_{ref}$, a $K_{MAP}$ modification rate indicative constant $M_{MAP}$ is set at a given first value, at a step 1528. On the other hand, when the $K_{ALT}$ learning counter value $L_{KALT}$ is smaller than the $K_{ALT}$ learning threshold $LKALT_{ref}$, a $K_{MAP}$ modification rate indicative constant $M_{MAP}$ is set at a given second value which is smaller than the first value at a step 1530.

Based on the average value $LAMBDA_{ave}$ derived at the step 1522 and the $K_{MAP}$ modification rate indicative constant $M_{MAP}$ as derived at the step 1528 or, 530, data of the engine driving range based learned correction coefficient $K_{MAP}$ as read at the step 1524, is modified, at a step 1532. Modification of the engine driving range based correction coefficient $K_{MAP}$ is performed by:

$$K_{MAP}' = K_{MAP} + M_{MAP} \times LAMBDA_{ave}$$

where $K_{MAP}'$ is a modified correction coefficient.

The modified correction coefficient $K_{MAP}'$ is temporarily stored in a temporary register 144. After the step 1532, the updating indicative flag $FL_{UPDATE}$ is set at a step 1534 and the second correction coefficient error value $ELAMBDA_2$ is set in the memory block 143 as the first correction coefficient error value $ELAMBDA_1$ next cycle of execution, at a step 1536.

By providing the $K_{MAP}$ learning cycle counter $C_{MAP}$, updating of the correction coefficient $K_{MAP}$ in the $K_{MAP}$ map is performed only when the learning routine is repeated four cycles or more under substantially the same engine driving condition in the same engine driving range.

Figure 11:
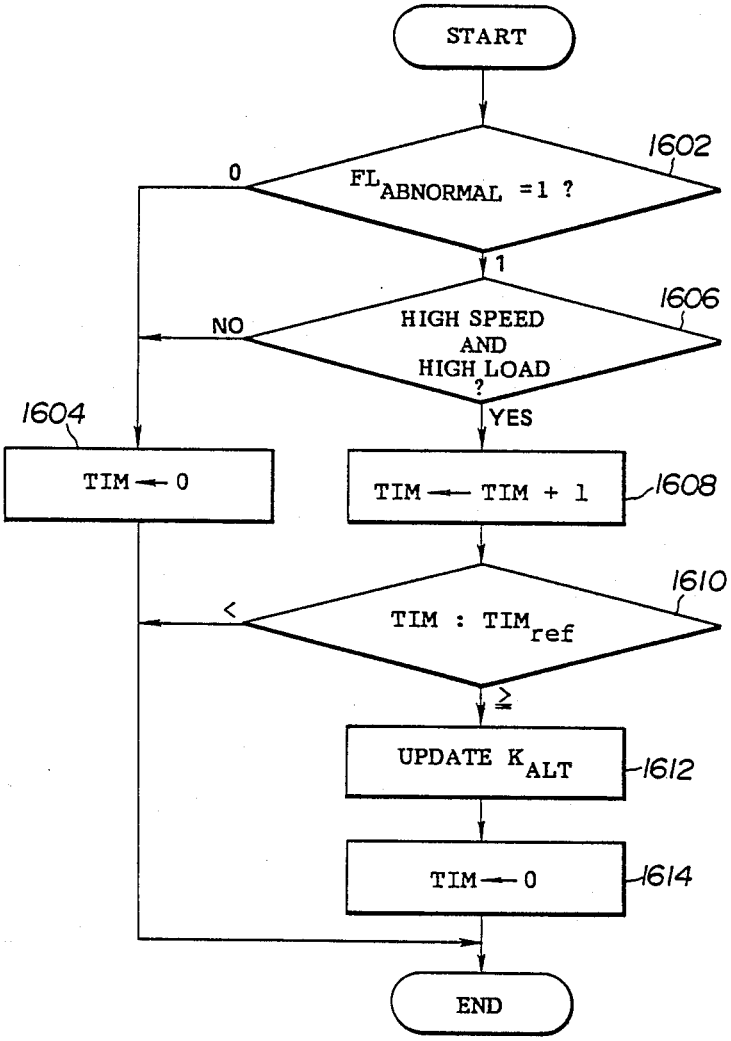
FIG. 11 is a flowchart of an automatically modifying routine for $K_{ALT}$ for modifying the $K_{ALT}$ automatically.

FIG. 11 shows a routine for automatically modifying the learnt uniform correction coefficient $K_{ALT}$ during engine driving at substantially high engine speed and high engine load condition. Such automatic modification of the air density dependent uniform correction coefficient $K_{ALT}$ becomes necessary when the engine is held at high speed and high load condition where FEEDBACK control is held inactive for a long period of time. Such engine driving condition tends to appear during hill or mountain climbing, for example.

Immediately after starting execution, the faulty sensor indicative flag $FL_{ABNORMAL}$ is checked at a step 1602. When the faulty sensor indicative flag $FL_{ABNORMAL}$ is set as checked at the step 1602, a FEEDBACK OFF timer value TIM of a FEEDBACK OFF timer 152 is cleared at a step 1604. Thereafter, process goes END.

Figure 12:
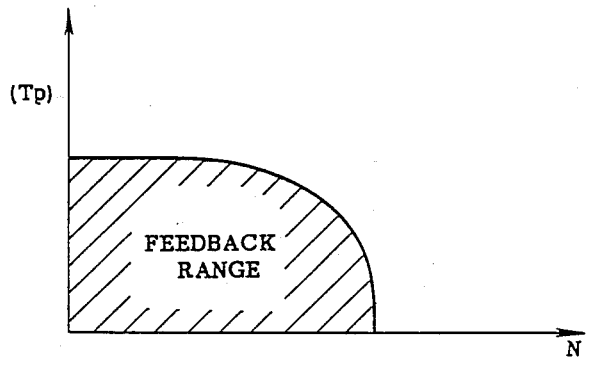
FIG. 12 is a chart showing FEEDBACK control range which is defined in terms of engine speed N and engine load Tp.

On the other hand, when the faulty sensor indicative flag $FL_{ABNORMAL}$ is not set as checked at the step 1602, the engine speed data N and the engine load data Tp are checked so as to check whether the engine is driven in high speed and high load condition, at a step 1606. In the practice, distinction of the engine driving condition is performed with respect to the air/fuel ratio FEEDBACK control criteria set with respect to the engine speed N and the engine load indicative basic fuel injection amount value Tp, as shown in FIG. 12. As will be seen from FIG. 12, when the engine driving condition as defined by the engine speed data N and the engine load Tp is out of the hatched region where air/fuel ratio FEEDBACK control is to be performed, judgement is to be made that the engine is in high speed and high load range. In the chart of FIG. 12, the high speed and high load range is set to include part of the engine medium speed and medium load range which is possible to perform air/fuel ratio FEEDBACK control and thus is possible to perform $K_{ALT}$ learning during driving in high altitude area.

When the engine driving condition as checked at the step 1606 is not the high speed and high load range, process goes to the step 1604 and subsequently goes END. On the other hand, when the engine driving condition is within high speed and high load range, the FEEDBACK OFF timer value TIM is incremented by one (1), at a step 1608. Then, the FEEDBACK OFF timer value TIM is compared with a predetermined FEEDBACK OFF timer threshold $TIM_{ref}$ at a step 1610. If the FEEDBACK OFF timer value TIM is smaller than the FEEDBACK OFF timer threshold $TIM_{ref}$ as checked at the step 1610, process goes END. On the other hand, when the FEEDBACK OFF timer value TIM is greater than or equal to the FEEDBACK OFF timer threshold $TIM_{ref}$, a given value $KALT_{modi}$ is subtracted from the air density dependent uniform correction coefficient $K_{ALT}$, at a step 1612 for modification. After modifying the air density dependent uniform correction coefficient at the step 1612, the FEEDBACK OFF timer value TIM is cleared at a step 1614. Then, process goes END.

As will be appreciated herefrom, according to the shown process to be performed by the preferred embodiment of the air/fuel ratio control system, according to the invention, air density dependent uniform correction coefficient can be learned even at high speed and high load engine driving condition so as to follow the air/fuel mixture ratio control to the air density at any environmental condition.

Figure 14:
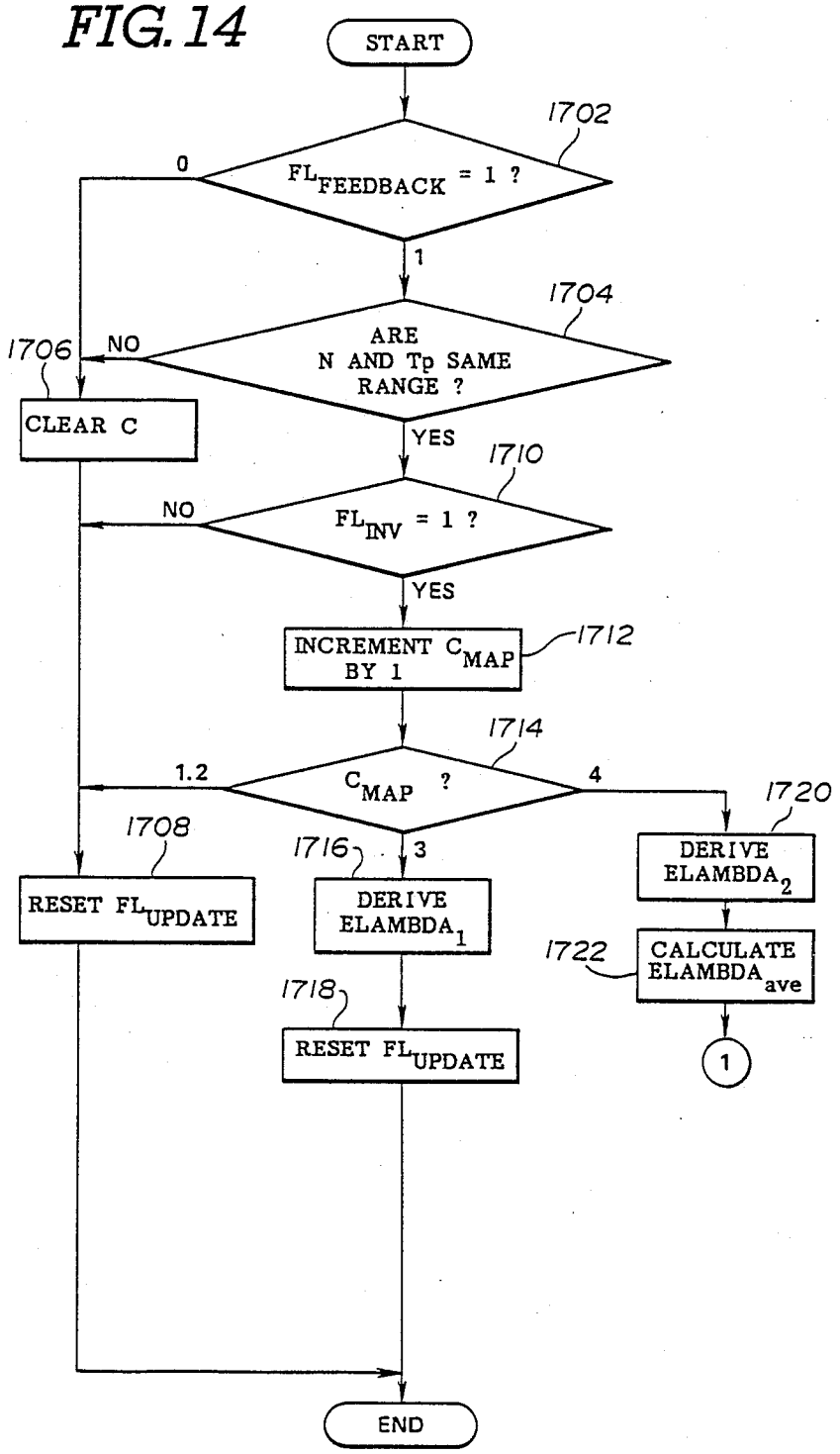
FIGS. 14 and 15 are flowcharts showing a sequence of $K_{MAP}$ learning routine as modification of the routine of FIG. 8.
Figure 15:
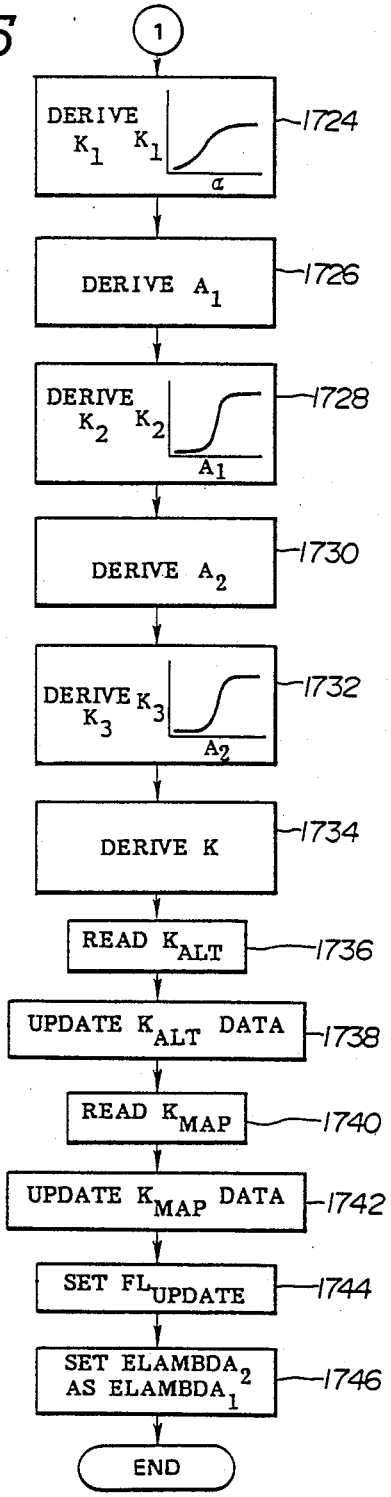

FIGS. 14 and 15 shows a modification of the $K_{MAP}$ learning routine, which modification is intended to divide correction coefficient error value ELAMBDA to be used in derivation of the engine driving range based learnt correction coefficient $K_{MAP}$ into first altitude dependent component and second component depending on other factors in order to introduce an inference factor in air/fuel ratio control.

In FIGS. 14 and 15, there is shown a sequence of routine for learning the engine driving range based learned correction coefficient $K_{MAP}$. As set forth above, learning of the correction coefficient is performed only when the control mode is FEEDBACK mode. Therefore, at a step 1702, check is performed whether the FEEDBACK condition indicative flag $FL_{FEEDBACK}$ is set or not. If the FEEDBACK condition indicative flag $FL_{FEEDBACK}$ is set as checked at the step 1702, check is performed whether the engine speed data N and the basic fuel injection amount Tp identifies the same engine driving range as that identified in the former execution cycle, at a step 1704. In practice, check in the step 1704 is performed by comparing the address data identifying corresponding memory block in the $K_{MAP}$ map. The address data identified by the engine speed data N and the basic fuel injection amount Tp is temporarily stored in a memory block 141 of RAM 106. When FEEDBACK condition indicative flag $FL_{FEEDBACK}$ is not set as checked at the step 1702 or when the address data as compared at the step 1704 do no match with the address data stored in the memory block 141 which means that the engine speed data N and the basic fuel injection amount Tp identifies different engine driving range than that identified in the former execution cycle, an updating counter 142 in the control unit 100 is reset to clear the $K_{MAP}$ learning cycle counter value $C_{MAP}$, at a step 1706. At a step 1708, the updating indicative flag $FL_{UPDATE}$ is reset.

On the other hand, when the address data compared the address data stored in the memory block 142 matches with the latter, the inversion indicative flag $FL_{INV}$ is checked at a step 1710. When the inversion indicative flag $FL_{INV}$ is not set as checked at the step 1710, process goes to the step 1708 to reset the updating indicative flag $FL_{UPDATE}$.

When the inversion indicative flag $FL_{INV}$ is set as checked at the step 1710, the $K_{MAP}$ learning cycle counter $C_{MAP}$ is incremented by 1, at a step 1712. After this, the $K_{MAP}$ learning cycle counter value $C_{MAP}$ is checked at a step 1714. This $K_{MAP}$ learning cycle counter $C_{MAP}$ serves to count up occurrence of updating of updating of the feedback correction coefficient $K_{LAMBDA}$ while the engine driving range is held in the one range.

When the $K_{MAP}$ learning cycle counter value $C_{MAP}$ is 1 or 2, process goes to the step 1708. On the other hand, when the $K_{MAP}$ learning cycle counter value $C_{MAP}$ is 3, a first correction coefficient error value $ELAMBDA_1$ is derived at a step 1716. The first correction coefficient error value ELAMBDA represents a difference between the feedback correction coefficient $K_{LAMBDA}$ and a coefficient reference value $LAMBDA_{ref}$, e.g. 1, and is temporarily stored in a memory block 143 of RAM 106. After this the updating flag $FL_{UPDATE}$ is reset at a step 1718.

After the process at the step 1708 or 1718, process goes END.

On the other hand, when the $K_{MAP}$ learning cycle counter value $C_{MAP}$ is greater than or equal to 4, a second correction coefficient error value $ELAMBDA_2$ is derived on the basis of the instantaneous feedback correction coefficient $K_{LAMBDA}$ and the coefficient reference value $LAMBDA_{ref}$, at a step 1720. An average value $LAMBDA_{ave}$ of the first and second correction coefficient error values $ELAMBDA_1$ and $ELAMBDA_2$ is then calculated at a step 1722.

The average value $LAMBDA_{ave}$ may include the first altitude dependent component and the second component depending upon other factors. Therefore, in the shown process, a ratio k of the first component versus the second component is derived through steps 1724 through 1734 which will be discussed later.

At the step 1724, a throttle angle dependent first component ratio indicative value $k_1$ is derived in terms of the throttle angle indicative signal value $\theta_{th}$ utilizing a $k_1$ map 153 set in ROM 104. This $k_1$ table 153 contains experimentarily obtained values, which becomes greater at greater throttle open angle range, as shown in the block of the step 1724 in FIG. 15. This $k_1$ value corresponds to a membership coefficient. Since the influence to the air/fuel ratio fluctuation of error in fuel injection amount, error in measurement of the throttle angle position, tolerance of various components and so forth is relatively great in engine low load condition, the $k_1$ ratio representing ratio of the first altitude dependent component versus the second component depending on the other factor is held small. Since the influence of the second component to the air/fuel ratio fluctuation becomes smaller in the engine high load range, the influence of the altitude become greater as shown.

Though the shown embodiment employs the throttle angle position as a factor representing the engine load condition, it may be possible to take other equivalent factor, such as basic fuel injection amount Tp, the intake air flow rate Q. Furthermore, the $k_1$ value may also be derived in terms of a combination of the engine speed and the engine load.

At a step 1726, number of $K_{MAP}$ table areas which is recently updates is checked for a given number of most recently updated areas. In the process of the step 1726, polarities of differences between previously set values and the updated values in respective of the $K_{MAP}$ table areas to be checked, are detected. Namely, when the engine driving range based learnt correction coefficient $K_{MAP}$ is increased in updating, the polarity of the difference becomes position, and, on the other hand, when the the engine driving range based learned correction coefficient $K_{MAP}$ is decreased in updating, the polarity of the difference becomes negative. The area in which the positive difference is detected will be hereafter referred to as "positive difference area" and the area in which the negative difference is detected will be hereafter referred to as "negative difference area". In operation of the step 1726, numbers of the positive difference areas and the negative difference areas are counted. One of the greater number of the positive difference area number and the negative difference area number is taken as a same difference polarity area number $A_1$. Based on the same difference polarity area number $A_1$ as derived at the step 1726, a second component ratio indicative value $k_2$ is derived by utilizing a $k_2$ map 154 in ROM 104, at a step 1728. As will be seen in the block 1728 of FIG. 15, the second component ratio indicative value $k_2$ increases according to increasing of the same difference polarity area number $A_1$. Namely, during up-hill driving or down-hill driving, updating area tends to incline to one of the positive difference areas and the negative difference area. For instance, during up-hill driving where altitude is gradually increased and air density is gradually decreased, number of the negative difference areas becomes substantially greater than that of the positive difference areas. On the other hand, during down-hill driving, the number of positive difference areas is increased to be substantially greater than the negative difference area.

At a step 1730, number of $K_{MAP}$ areas having the same polarity with respect to a reference value (0). Namely, number of the positive polarity areas and number of the negative polarity areas are compared. Greater number of one of the positive polarity areas and the negative polarity areas will be taken as same polarity area number $A_2$. Based on this same polarity area number $A_2$, a third component ratio indicative value $k_3$ is determined at a step 1732, by utilizing $k_3$ map 154 set in ROM 104. At the high altitude region, the air/fuel ratio tends to be richer due to lower air density to cause increasing of lean-side correction coefficient. Therefore, in such high altitude region, negative polarity area tends to be increased. In the alternative, at low altitude region, the air/fuel ratio tends to become leaner due to higher air density to require richer-side air/fuel ratio control. Therefore, in this region, positive polarity area is increased. In this view, the $k_3$ map is designed to increase the value according to increasing of the same polarity area number $A_2$.

After the step 1732, an average component ratio value which serves as a control coefficient k, is derived by obtaining average value of the first, second and third component ratio indicative values $k_1$, $k_2$ and $k_3$, at a step 1734.

At a step 1736, the air density dependent uniform correction coefficient $K_{ALT}$ is read. Based on the average value $LAMBDA_{ave}$ derived at the step 1722 and the control coefficient k as derived at the step 1734, data of the air density dependent uniform correction coefficient $K_{ALT}$ as read at the step 1736, is modified, at a step 1738. Modification of the air density dependent uniform correction coefficient $K_{ALT}$ is performed by:

$$K_{ALT}' = K_{ALT} + M_{ALT} \times LAMBDA_{ave} \times k$$

where $K_{ALT}'$ is a modified correction coefficient.

The modified correction coefficient $K_{ALT}'$ is temporarily stored in a temporary register 144.

At a step 1740, the engine driving range based learned correction coefficient $K_{MAP}$ is read in terms of the engine speed data N and the basic fuel injection value Tp. Based on the average value $LAMBDA_{ave}$ derived at the step 1722 and the control coefficient k as derived at the step 1734, data of the engine driving range based learnt correction coefficient $K_{MAP}$ as read at the step 1740, is modified, at a step 1742. Modification of the engine driving range based correction coefficient $K_{MAP}$ is performed by:

$$K_{MAP}' = K_{MAP} + M_{MAP} \times LAMBDA_{ave} \times (1-k)$$

where $K_{MAP}'$ is a modified correction coefficient.

The modified correction coefficient $K_{MAP}'$ is temporarily stored in a temporary register 144. After the step 1742, the updating indicative flag $FL_{UPDATE}$ is set at a step 1744 and the second correction coefficient error value $ELAMBDA_2$ is set in the memory block 143 as the first correction coefficient error value $ELAMDA_1$ for next cycle of execution, at a step 1746.

By the modification process shown in FIGS. 14 and 15, the control feature can be introduced in learning of the air density dependent uniform correction coefficient $K_{ALT}$.

It should be appreciated that, though the shown embodiment takes three component ratio indicative values $k_1$, $k_2$ and $k_3$, fuzzy control feature may be introduced in derivation of the air density dependent uniform correction coefficient $K_{ALT}$ by utilizing two of three values.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

What is claimed is:

1. An air/fuel ratio control system for controlling a mixture ratio of an air/fuel mixture to be introduced into a combustion chamber in an internal combustion engine, comprising:

an air/fuel mixture induction system for introducing an intake air and a fuel for forming an air/fuel mixture to be supplied into an engine combustion chamber, said air/fuel mixture delivery system incorporating a fuel metering means for delivering a controlled amount of fuel;

a first sensor means for monitoring a preselected basic first engine operation parameter to produce a first sensor signal indicative thereof;

a second sensor means for monitoring an air/fuel mixture ratio indicative parameter for producing a second sensor signal variable of the value indicative of a deviation from a threshold value representative of a stoichiometric value;

third means for deriving a basic fuel metering amount on the basis of said first sensor signal value;

fourth means for deriving a air/fuel ratio dependent correction factor variable of the value thereof depending upon said second sensor signal value;

fifth means for deriving an air density dependent first correction coefficient on the basis of said air/fuel ratio dependent correction factor for air/fuel ratio dependent correction of said basic fuel metering amount, which first correction coefficient is commonly applicable for correction of said basic fuel metering amount in over all engine driving ranges, said fifth means updating said first correction coefficient when a first learning condition is satisfied;

a sixth means for deriving a second correction coefficient which is variable depending upon the engine driving range on the basis of said air/fuel ratio dependent correction factor, said sixth means setting a plurality of said second correction coefficient in relation to respectively corresponding engine driving range and updating each of said second correction coefficient with an instantaneous value derived based on said air/fuel ratio dependent correction factor in the corresponding engine driving range;

a seventh means for detecting engine driving condition on the basis of said first sensor signal values and governing said fifth and sixth means for selectively operating one of said fifth and sixth means depending upon the detected engine driving condition; and an eighth means for correcting said basic fuel metering amount with said correction coefficient to control said fuel metering means for delivering the fuel in the amount corresponding to the corrected fuel metering amount to said air/fuel mixture delivery system.

2. An air/fuel ratio control system as set forth in claim 1, wherein said seventh means detects said engine driving condition satisfying a predetermined feedback control condition for producing a feedback condition indicative signal to selectively enable said fifth and sixth means for updating one of said first and second correction coefficient and to disable said fifth and sixth means when said feedback condition is not satisfied.

3. An air/fuel ratio control system as set forth in claim 1, which further comprises a ninth means for detecting engine driving condition in high speed and high load, which is out of said feedback condition, to measure an elapsed period where said high speed and high load condition is maintained, said ninth means modifying said first correction coefficient when the measured elapsed time becomes longer than or equal to a predetermined period.

4. An air/fuel ratio control system as set forth in claim 3, wherein said ninth means cyclically modifies said first correction coefficient by a predetermined value while the engine is maintained at said high speed and high load condition.

5. An air/fuel ratio control system as set forth in claim 4, wherein said second sensor means varies polarity of said second sensor signal value when air/fuel ratio varies across a stoichiometric value, and which further comprises a tenth means for measuring an elapsed time in which the polarity of said second sensor signal value is held unchanged to detect abnormality of said second sensor means.

6. An air/fuel ratio control system as set forth in claim 5, wherein said tenth means disables said ninth means when abnormality of said second sensor means is detected.

7. An air/fuel ratio control system as set forth in claim 1, wherein said first sensor means includes means for monitoring an engine load indicative parameter and means for monitoring an engine speed indicative parameter, and said seventh means derives a first criterion on the basis of an engine speed derived on the basis of the monitored engine speed indicative parameter and compares an engine load derived based on said engine load indicative parameter with said first criterion for enabling said fifth means when said engine load is greater than or equal to said first criterion, and enabling said sixth means when said engine load is smaller than said first criterion.

8. An air/fuel ratio control system as set forth in claim 7, wherein said seventh means further derives a second criterion on the basis of said engine speed, which second criterion is set at a greater value than said first criterion and compares said engine load with said second criterion so as to disable said fifth means when said engine load is greater than said second criterion.

9. An air/fuel ratio control system as set forth in claim 1, wherein said second sensor means varies polarity of said second sensor signal value when air/fuel ratio varies across a stoichiometric value, and said fifth and sixth means, as being triggered by said seventh means, being responsive to change of polarity of said second sensor signal to update said first and second correction coefficients.

10. An air/fuel ratio control system as set forth in claim 1, which further comprises a detector means detective of engine driving condition satisfying a predetermined feedback control condition for producing a feedback condition indicative signal to operate said eighth means in feedback mode for correcting said basic fuel metering amount with said first and second correction coefficients and to operate said eighth means in open loop mode for disabling correction of said basic fuel metering amount utilizing said first and second correction coefficients, and said seventh means selectively enables said fifth and sixth means for updating said first and second correction coefficients while said eighth means operates in feedback mode.

11. An air/fuel ratio control system as set forth in claim 10, wherein said fourth means is active in presence of said feedback condition indicative signal to cyclically derive said correction factor, and said sixth means is active for deriving said second correction coefficient on the basis of said correction factor only when said feedback condition indicative signal is present.

12. An air/fuel ratio control system as set forth in claim 11, wherein said fourth means samples upper and lower peak values of said second sensor signal value for deriving said correction factor by averaging said upper and lower peak values.

13. An air/fuel ratio control system as set forth in claim 1, wherein said first sensor means monitors an engine speed indicative parameter and an engine load indicative parameter so that said third means derives said basic fuel metering amount on the basis of said engine speed indicative parameter and said engine load indicative parameter, and said fifth means detects said engine driving range on the basis of said engine speed and said basic fuel metering amount.

14. An air/fuel ratio control system as set forth in claim 13, wherein said first sensor means monitors a throttle valve angular position and derives said engine load indicative parameter on the basis of said throttle valve angular position and said engine speed.

15. An air/fuel ratio control system for controlling a mixture ratio of an air/fuel mixture to be introduced into a combustion chamber in an internal combustion engine, comprising:

an air/fuel mixture induction system for introducing an intake air and a fuel for forming an air/fuel mixture to be supplied into an engine combustion chamber, said air/fuel mixture delivery system incorporating a fuel metering means for delivering a controlled amount of fuel;

a first sensor means for monitoring a preselected basic first engine operation parameter to produce a first sensor signal indicative thereof, said first sensor signal including an engine load indicative component;

a second sensor means for monitoring an air/fuel mixture ratio indicative parameter for producing a second sensor signal variable of the value indicative of a deviation from a threshold value representative of a stoichiometric value;

third means for deriving a basic fuel metering amount on the basis of said first sensor signal value;

fourth means for deriving a air/fuel ratio dependent correction factor variable of the value thereof depending upon said second sensor signal value;

fifth means for deriving an air density dependent first correction coefficient on the basis of said air/fuel ratio dependent correction factor for air/fuel ratio dependent correction of said basic fuel metering amount, which first correction coefficient is commonly applicable for correction of said basic fuel metering amount in over all engine driving ranges, said fifth means updating said first correction coefficient when a first learning condition is satisfied;

a sixth means for deriving a second correction coefficient which is variable depending upon the engine driving range on the basis of said air/fuel ratio dependent correction factor, said sixth means setting a plurality of said second correction coefficient in relation to respectively corresponding engine driving range and updating each of said second correction coefficient with an instantaneous value derived based on said air/fuel ratio dependent correction factor in the corresponding engine driving range;

a seventh means, associated with said fifth means, for deriving an altitude dependent correction value for modifying said first correction value on the basis of said engine load component of said first sensor signal and a tendency of air/fuel ratio adjustment in a given cycles of said second sensor signal variations;

an eighth means for correcting said basic fuel metering amount with said correction coefficient to control said fuel metering means for delivering the fuel in the amount corresponding to the corrected fuel metering amount to said air/fuel mixture delivery system.

16. An air/fuel ratio control system as set forth in claim 15, wherein said seventh means increases altitude dependent correction value according to increase of said engine load.

17. An air/fuel ratio control system as set forth in claim 15, wherein said seventh means detects tendency of richer side or leaner side air/fuel ratio control depending upon distribution of richer side variation and leaner side variation of given number of said second correction coefficients updated by said sixth means in most recent given updating cycles.

18. An air/fuel ratio control system as set forth in claim 17, wherein said seventh means increases said altitude dependent correction value according to increase of tendency of either richer side or leaner side air/fuel control which is greater than the other.

19. An air/fuel ratio control system as set forth in claim 15, wherein said seventh means detects tendency of richer side or leaner side air/fuel ratio control depending upon distribution of said second correction values residing richer side and leaner side of a predetermined threshold value.

20. An air/fuel ratio control system as set forth in claim 19, wherein said seventh means increases said altitude dependent correction value according to increase of tendency of either richer side or leaner side distribution which is greater than the other.

21. An air/fuel ratio control system as set forth in claim 15, wherein said seventh means derives said altitude dependent correction value constituting a first component variable according to variation to variation of said engine load and a second component derived depending upon tendency of richer side or leaner side air/fuel ratio control depending upon distribution of richer side variation and leaner side variation of given number of said second correction coefficients updated by said sixth means in most recent given updating cycles.

22. An air/fuel ratio control system as set forth in claim 21, wherein said altitude dependent correction value is an average value of said first and second components.

23. An air/fuel ratio control system as set forth in claim 15, wherein said seventh means derives said altitude dependent correction value constituting a first component variable according to variation to variation of said engine load and a second component derived depending upon tendency of richer side or leaner side air/fuel ratio control depending upon distribution of said second correction values residing richer side and leaner side of a predetermined threshold value.

24. An air/fuel ratio control system as set forth in claim 23, wherein said altitude dependent correction value is an average value of said first and second components.

25. An air/fuel ratio control system as set forth in claim 15, wherein said seventh means derives said altitude dependent correction value constituting a first component variable according to variation to variation of said engine load, a second component derived depending upon tendency of richer side or leaner side air/fuel ratio control depending upon distribution of said second correction values residing richer side and leaner side of a predetermined threshold value, and a third component derived depending upon distribution of richer side variation and leaner side variation of given number of said second correction coefficients updated by said sixth means in most recent given updating cycles.

26. An air/fuel ratio control system as set forth in claim 25, wherein said altitude dependent correction value is an average value of said first, second and third components.

27. An air/fuel ratio control system as set forth in claim 15, wherein said first sensor means includes means for monitoring an engine load indicative parameter and means for monitoring an engine speed indicative parameter, and said seventh means derives a first criterion on the basis of an engine speed derived on the basis of the monitored engine speed indicative parameter and compares an engine load derived based on said engine load indicative parameter with said first criterion for enabling said fifth means when said engine load is greater than or equal to said first criterion, and enabling said sixth means when said engine load is smaller than said first criterion.

28. An air/fuel ratio control system as set forth in claim 15, wherein said second sensor means varies polarity of said second sensor signal value when air/fuel ratio varies across a stoichiometric value, and said fifth and sixth means, as being triggered by said seventh means, being responsive to change of polarity of said second sensor signal to update said first and second correction coefficients.

29. An air/fuel ratio control system as set forth in claim 15, which further comprises a detector means detective of engine driving condition satisfying a predetermined feedback control condition for producing a feedback condition indicative signal to operate said eighth means in feedback mode for correcting said basic fuel metering amount with said first and second correction coefficients and to operate said eighth means in open loop mode for disabling correction of said basic fuel metering amount utilizing said first and second correction coefficients, and said seventh means selectively enables said fifth and sixth means for updating said first and second correction coefficients while said eighth means operates in feedback mode.

30. An air/fuel ratio control system as set forth in claim 29, wherein said fourth means is active in presence of said feedback condition indicative signal to cyclically derive said correction factor, and said sixth means is active for deriving said second correction coefficient on the basis of said correction factor only when said feedback condition indicative signal is present.

31. An air/fuel ratio control system as set forth in claim 30, wherein said fourth means samples upper and lower peak values of said second sensor signal value for deriving said correction factor by averaging said upper and lower peak values.

32. An air/fuel ratio control system as set forth in claim 15, wherein said first sensor means monitors an engine speed indicative parameter and an engine load indicative parameter so that said third means derives said basic fuel metering amount on the basis of said engine speed indicative parameter and said engine load indicative parameter, and said fifth means detects said engine driving range on the basis of said engine speed and said basic fuel metering amount.

33. An air/fuel ratio control system as set forth in claim 32, wherein said first sensor means monitors a throttle valve angular position and derives said engine load indicative parameter on the basis of said throttle valve angular position and said engine speed.

* * * * *